US005449598A

United States Patent [19]

Saito et al.

[11] Patent Number: 5,449,598

[45] Date of Patent: Sep. 12, 1995

[54] SILVER HALIDE COLOR PHOTOGRAPHIC MATERIAL

[75] Inventors: Naoki Saito; Seiji Ichijima; Masuji Motoki; Takayoshi Kamio; Keiji Mihayashi, all of Kanagawa, Japan

[73] Assignee: Fuji Photo Film Co., Ltd., Kanagawa, Japan

[21] Appl. No.: 43,730

[22] Filed: Apr. 6, 1993

[30] Foreign Application Priority Data

Apr. 7, 1992 [JP] Japan ..... 4-113237

[51] Int. Cl.[6] ..... G03C 7/36

[52] U.S. Cl. ..... 430/557; 430/556

[58] Field of Search ..... 430/556, 557

[56] References Cited

U.S. PATENT DOCUMENTS

| | | | |
|---|---|---|---|
| 3,730,722 | 5/1973 | Inoue et al. | 430/557 |
| 4,356,258 | 10/1982 | Usui et al. | 430/557 |
| 4,443,536 | 4/1984 | Lestina | 430/552 |
| 4,617,256 | 10/1986 | Kunitz et al. | 430/557 |

FOREIGN PATENT DOCUMENTS

| | | |
|---|---|---|
| 62-61251 | 2/1982 | Japan . |
| 3-67255 | 3/1991 | Japan . |
| 3-134659 | 6/1991 | Japan . |
| 5-19426 | 1/1993 | Japan . |
| 909318 | 10/1962 | United Kingdom . |

*Primary Examiner*—Lee C. Wright

*Attorney, Agent, or Firm*—Birch, Stewart, Kolasch & Birch

[57] ABSTRACT

A silver halide color photographic material is disclosed, which comprises a support having provided thereon at least one hydrophilic colloidal layer, wherein the hydrophilic colloidal layer contains a novel coupler compound having a high dye forming rate and a high color density represented by general formula (I):

$$(R^1COCHXCONR^2R^3)\text{—}(CONHSO_2R^4)_n \qquad (I)$$

wherein $R^1$ represents an alkyl group, an aryl group, a heterocyclic group, —$NR^5R^6$ or —$OR^7$; $R^2$ and $R^3$ each independently represents a hydrogen atom, an alkyl group, an aryl group or a heterocyclic group; $R^4$ represents an alkyl group, aryl group, heterocyclic group or —$NR^8R^9$; $R^5$, $R^6$, $R^8$ and $R^9$ each independently represents a hydrogen atom, an alkyl group, an aryl group or a heterocyclic group; $R^7$ represents an alkyl group, an aryl group or a heterocyclic group; X represents a group capable of being released as an anion ($X^-$) when the coupler compound reacts with an oxidation product of an aromatic primary amine developing agent; and n represents an integer of 1 or more, with the proviso that $R^1$ and $R^4$, $R^2$ and $R^4$, $R^3$ and $R^4$, $R^2$ and $R^3$, $R^5$ and $R^6$, or $R^8$ and $R^9$ may be connected to each other to form a ring. The silver halide color photographic material using the novel coupler compound provides a higher sharpness and a higher sensitivity.

11 Claims, No Drawings

SILVER HALIDE COLOR PHOTOGRAPHIC MATERIAL

FIELD OF THE INVENTION

The present invention relates to a silver halide color photographic material comprising a novel coupler. More particularly, the present invention relates to a color photographic light-sensitive material which can be subjected to image formation in the presence of a novel coupler having a high reactivity to provide a higher sharpness and a higher sensitivity, than conventional silver halide color photographic materials.

BACKGROUND OF THE INVENTION

In a color photographic process a color photographic light-sensitive material is exposed to light, and then subjected to color development so that an oxidation product of an aromatic primary amine developing agent reacts with a coupler to form an image on the material. In such a process, a subtractive color process is used for color reproduction, where in order to reproduce blue, green and red images, there are formed yellow, magenta and cyan images, which respectively are complementary thereto.

Couplers are basically required not only to form colors but also to exhibit various excellent properties. For example, dyes developed from couplers should have excellent spectral absorption characteristics. Further, couplers should develop dyes at a high rate, and these dyes should provide a high color density. Dyes thus developed from couplers should exhibit a high fastness to heat, light and moisture. In recent years, since the markets have demanded a photographic light-sensitive material with a higher sensitivity and a higher image quality, than conventional materials. It has been keenly desired to develop a coupler which can form a dye at a high rate and provide a high color density. Further, in the design of DIR couplers (i.e., couplers which react with an oxidation product of an aromatic primary amine developing agent to release a development inhibitor and thus are used for the purpose of improving image sharpness and color reproducibility), the aforementioned properties can be important factors. In the case of yellow couplers, one effective approach for enhancing the rate at which dyes are formed is to introduce an acidic separatable group or high polarity group into the coupler molecule. Examples of such an approach include the introduction of a p-hydroxybenzenesulfonyl group or p-hydroxybenzenesulfinyl group as described in U.S. Pat. No. 4,443,536, and the introduction of an N-acylsulfamoyl group as described in British Patent 909,318, U.S. Pat. No. 4,617,256, and JP-B-62-61251 (The term "JP-B" as used herein means an "examined Japanese patent publication"). However, these prior approaches leave much to be desired.

SUMMARY OF THE INVENTION

It is therefore an object of the present invention to provide a color photographic light-sensitive material material which can be subjected to image formation in the presence of a coupler which exhibits a high dye forming rate and provides a high color density to provide a higher sharpness and a higher sensitivity.

The object of the present invention is accomplished with a silver halide color photographic material comprising a support having provided thereon at least one hydrophilic colloidal layer, wherein said hydrophilic colloidal layer contains a coupler compound represented by general formula (I):

$$(R^1COCHXCONR^2R^3)—(CONHSO_2R^4)_n \quad (I)$$

wherein $R^1$ represents an alkyl group, an aryl group, a heterocyclic group, —$NR^5R^6$ or —$OR^7$; $R^2$ and $R^3$ each independently represent a hydrogen atom, an alkyl group, an aryl group or a heterocyclic group; $R^4$ represents an alkyl group, an aryl group, a heterocyclic group or —$NR^8R^9$; $R^5$, $R^6$, $R^8$ and $R^9$ each independently represent a hydrogen atom, an alkyl group, an aryl group or a heterocyclic group; $R^7$ represents an alkyl group, an aryl group or a heterocyclic group; X represents a group capable of being released as an anion ($X^-$) when said coupler compound reacts with an oxidation product of an aromatic primary amine developing agent; and n represents an integer of 1 or more, with the proviso that $R^1$ and $R^4$, $R^2$ and $R^4$, $R^3$ and $R^4$, $R^2$ and $R^3$, $R^5$ and $R^6$, or $R^8$ and $R^9$ may be connected to each other to form a ring. The aforementioned object of the present invention, as well as the scope of the present inventive discovery will become more apparent from the following detailed description and examples.

DETAILED DESCRIPTION OF THE INVENTION

The compound represented by general formula (I) to be used in the present invention will be further described hereinafter.

In general formula (I), the alkyl group represented by $R^1$, $R^2$, $R^3$, $R^4$, $R^5$, $R^6$, $R^7$, $R^8$ or $R^9$ is a $C_{1-30}$, preferably a $C_{3-30}$, and most preferably a $C_{3-22}$, straight-chain or branched-chain or cyclic alkyl group. Examples of such an alkyl group include methyl, ethyl, propyl, isopropyl, t-butyl, t-amyl, cyclopropyl, cyclohexyl, 2-ethylhexyl, isobutyl, isoamyl, t-octyl, neopentyl, and dodecyl. These alkyl groups may be further substituted.

In general formula (I), the aryl group represented by $R^1$, $R^2$, $R^3$, $R^4$, $R^5$, $R^6$, $R^7$, $R^8$ or $R^9$ is preferably a $C_{6-20}$, more preferably a $C_{6-10}$, and most preferably a $C_6$ aryl group. Examples of such an aryl group include phenyl, naphthyl, and anthracenyl. These aryl groups may be further substituted.

In general formula (I), the heterocyclic group represented by $R^1$, $R^2$, $R^3$, $R^4$, $R^5$, $R^6$, $R^7$, $R^8$ or $R^9$ is preferably a 5- to 7-membered heterocyclic group having a nitrogen atom, an oxygen atom and a sulfur atom as a ring hetero atom. The carbon number of the heterocyclic group is preferably from 1 to 10. Examples of such a heterocyclic group include 2-furyl, 2-thienyl, 2-pyridyl, 2-imidazolyl, 2-(1,3-oxazolyl), 5-tetrazolyl, 1-piperidinyl, 5-indolinyl, 1,3,4-thiadiazole, benzoxazole-2-yl, benzothiazole-2-yl, benzoimidazole-2-yl, 1,2,4-triazole-5-yl, 3-pyrazolyl, 2-morpholyl, 4-morpholyl, 2-quinolyl, and 2-quinazolyl. These heterocyclic groups may be further substituted.

In general formula (I), X represents a group capable of being released as an anion ($X^-$) when the coupler compound reacts with an oxidation product of an aromatic primary amine developing agent. Preferred examples of the group represented by X include an aryloxy group (e.g., phenoxy, and naphthoxy), a heterocyclicoxy group, arylthio group, a heterocyclicthio group, an imide group which connected to the coupling position via a nitrogen atom (e.g., 2,4-dioxo-1,3-imidazolidine-3-yl, 2,4-dioxo-1,3-oxazolidine-3-yl, 3,5-dioxo-1,2,4-triazolidine-4-yl, succinimide, phthalimide, 2,4-dioxo-1,3-imidazolidine-1-yl), and an unsaturated nitrogen-containing heterocyclic group (e.g., 1-imidazolyl, 1-pyrazolyl, 1,2,4-triazole-1(or 4)-yl, 1,2,3-triazole-1-yl, benzotriazole-1-yl, 3-pyrazoline-5-one-1-yl).

These releasable groups may be a photographically useful groups, or a photographically unuseful group, or a precursor thereof (e.g., development inhibitors, development accelerators, desilvering accelerators, fogging agents, dyes, film hardeners, couplers, developing agent oxidant scavengers, fluorescent dyes, developing agents, electron transfer agents).

Specific examples of the photographic useful group represented by X include those which have heretofore been known. Examples of such groups are disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, and European Patents 193 389 A, 348 139 A and 272 573 A. Preferred among the photographically useful groups are development inhibitors, electron transfer agents, desilvering accelerators (bleach accelerators), and dyes.

If $R^1$, $R^2$, $R^3$, $R^4$, $R^5$, $R^6$, $R^7$, $R^8$, $R^9$ and X each represents an alkyl group, aryl group or heterocyclic group or another group containing such a group, they may contain substituents. Examples of such substituents include a halogen atom (e.g., fluorine, and chlorine), an alkoxycarbonyl group (e.g., a $C_{2-30}$, preferably $C_{2-20}$ alkoxycarbonyl group, such as methoxycarbonyl, dodecyloxycarbonyl, and hexadecyloxycarbonyl), an acylamino group (e.g., a $C_{2-30}$, preferably $C_{2-20}$ acylamino group, such as acetamide, tetradecanamide, 2-(2,4-di-t-amylphenoxy)butanamide, and benzamide), a sulfonamide group (e.g., a $C_{1-30}$, preferably $C_{1-20}$ sulfonamide group, such as methanesulfonamide, dodecanesulfonamide, hexadecanesulfonamide, and benzenesulfonamide), a carbamoyl group (e.g., a $C_{1-30}$, preferably $C_{1-20}$ carbamoyl group, such as N-butylcarbamoyl, N,N-diethylcarbamoyl, and N-methylcarbamoyl), a sulfamoyl group (e.g., a $C_{0-30}$, preferably $C_{0-20}$ sulfamoyl group, such as N-butylsulfamoyl, N-dodecylsulfamoyl, N-hexadecylsulfamoyl, N-3(2,4-di-t-amylphenoxy)butylsulfamoyl, and N,N-diethylsulfamoyl), an alkoxy group (e.g., a $C_{1-30}$, preferably $C_{1-20}$ alkoxy group, such as methoxy, hexadecyloxy, and isopropoxy), an aryloxy group (e.g., a $C_{6-20}$, preferably $C_{6-10}$ aryloxy group, such as phenoxy, 4-methoxyphenoxy, 3-t-butyl-4-hydroxyphenoxy, and naphthoxy), an aryloxycarbonyl group (e.g., a $C_{7-21}$, preferably $C_{7-11}$ aryloxycarbonyl group, such as phenoxycarbonyl), an N-acylsulfamoyl group (e.g., a $C_{2-30}$, preferably $C_{2-20}$ N-acylsulfamoyl group, such as N-propanoylsulfamoyl, N-tetradecanoylsulfamoyl, and N-benzoylsulfamoyl), a sulfonyl group (e.g., a $C_{1-30}$, preferably $C_{1-20}$ sulfonyl group, such as methanesulfonyl, octanesulfonyl, benzenesulfonyl, and dodecanesulfonyl), an alkoxycarbonylamino group (e.g., a $C_{2-30}$, preferably $C_{2-20}$ alkoxycarbonylamino group, such as ethoxycarbonylamino, and tetradecyloxycarbonylamino), a cyano group, a nitro group, a carboxyl group, a hydroxyl group, a sulfo group, an alkylthio group (e.g., a $C_{1-30}$, preferably $C_{1-20}$ alkylthio group, such as methylthio, dodecylthio, and dodecylcarbamoylmethylthio), an ureido group (e.g., a $C_{1-30}$, preferably $C_{1-20}$ ureido group, such as N-phenylureido, and N-hexadecylureido), an aryl group (e.g., a $C_{6-20}$, preferably $C_{6-10}$ aryl group, such as phenyl, naphthyl, and 4-methoxyphenyl), a carbon-containing heterocyclic group (e.g., a $C_{1-20}$, preferably $C_{1-10}$ 3- to 12-membered, preferably 5- or 6-membered monocyclic or condensed heterocyclic group containing as a hetero ring atom a nitrogen atom, an oxygen atom or a sulfur atom, e.g., 2-pyridyl, 4-pyridyl, 4-pyrimidinyl, 3-pyrazolyl, 1-pyrrolyl, 2,4-dioxo-1,3-imidazolidine-1-yl, morpholino, and indolyl), an alkyl group (e.g., a $C_{1-30}$, preferably $C_{1-20}$ straight-chain, branched or cyclic alkyl group, such as methyl, ethyl, isopropyl, cyclopropyl, t-pentyl, t-octyl, cyclopentyl, t-butyl, sec-butyl, dodecyl, 2-hexyldecyl), an acyl group (e.g., a $C_{1-30}$, preferably $C_{2-20}$ acyl group, such as acetyl, and benzoyl), an arylthio group (e.g., a $C_{6-20}$, preferably $C_{6-10}$ arylthio group, such as phenylthio, and naphthylthio), a sulfamoylamino group (e.g., a $C_{0-30}$, preferably $C_{0-20}$ sulfamoylamino group, such as N-butylsulfamoylamino, N-dodecylsulfamoylamino, and N-phenylsulfamoylamino), and a N-sulfonylsulfamoyl group (e.g., a $C_{1-30}$, preferably $C_{1-20}$ N-sulfonylsulfamoyl group, such as N-methylsulfamoyl, N-ethanesulfonylsulfamoyl, N-dodecanesulfonylsulfamoyl, and N-hexadecanesulfonylsulfamoyl). These substituents may further contain substituents. Examples of such substituents include those described above.

The couplers represented by general formula (I) may be connected to each other at the group represented by X, $R^1$, $R^2$, $R^3$, $R^4$, $R^5$, $R^6$, $R^7$, $R^8$ or $R^9$ via a divalent or higher group to form a dimer or higher polymer (e.g., a telomer or polymer). In this case, the number of carbon atoms contained in the substituents may deviate from the above specified ranges.

Preferred examples of the compound represented by general formula (I) will be described hereinafter.

$R^1$ is preferably an alkyl group, aryl group or $—NR^5R^6$. The alkyl group represented by $R^1$ is particularly preferably a tertiary alkyl group such as t-butyl, t-amyl, cyclopropylmethyl and cyclopropylethyl. The aryl group represented by $R^1$ is particularly preferably a phenyl group. The $—NR^5R^6$ group represented by $R^1$ is particularly preferably an $—NR^5R^6$ group wherein $R^5$ or $R^6$ is a phenyl group, such as N-alkylanilino and 1-indolinyl.

$R^2$ is preferably a hydrogen atom.

$R^3$ is preferably an aryl group, particularly a phenyl group or naphthyl group. The phenyl group represented by $R^3$ is preferably a phenyl group containing a halogen atom or alkoxy group at the ortho position thereof.

$R^4$ is preferably an alkyl group or aryl group. The alkyl group represented by $R^4$ is preferably a methyl group, ethyl group or a $C_{3-30}$ n-alkyl group. The aryl group represented by $R^4$ is preferably a phenyl group.

X is preferably a nitrogen-containing heterocyclic group, particularly a 5-membered cyclic imide group (connected to the coupling position via a nitrogen atom), 1-pyrazolyl, 1-imidazolyl, 1,2,4-triazolyl (connected to the coupling position at its 1- or 4-position), 1-benzotriazolyl or 1,2,3-triazolyl.

In general formula (I), n is preferably an integer of from 1 to 4 and more preferably 1.

In general formula (I), $—CONHSO_2R^4$ preferably susbstitutes for hydrogen atom(s) at any position except at the carbon atom in the coupling position of the coupler and may substitute for hydrogen atom(s) in the dye forming portion and/or separatable group portion thereof. More preferably, $—CONHSO_2R^4$ may substitute for hydrogen atom(s) in $R^3$.

The coupler represented by general formula (I) is preferably a nondiffusive coupler. The term "nondiffusive coupler" as used herein means a "coupler containing a group which makes the molecular weight of the coupler molecule large enough to immobilize the coupler molecule in the layer in which it has been incorporated". As such a nondiffusive group there may be normally used a $C_{8-30}$, preferably $C_{10-20}$ alkyl group or $C_{4-20}$ substituted aryl group. Such a nondiffusive group may substitute for a hydrogen atom at any position in the coupler molecule. There may be contained a plurality of such nondiffusive groups in the coupler molecule.

Specific examples of the coupler represented by general formula (I) will be given below, but the present invention should not be construed as being limited thereto.

(1)

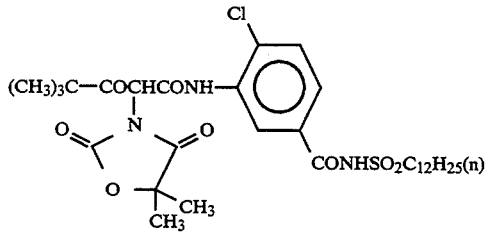

(2)

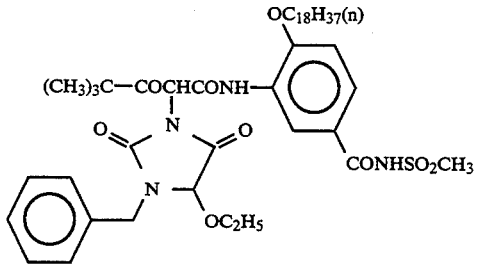

(3)

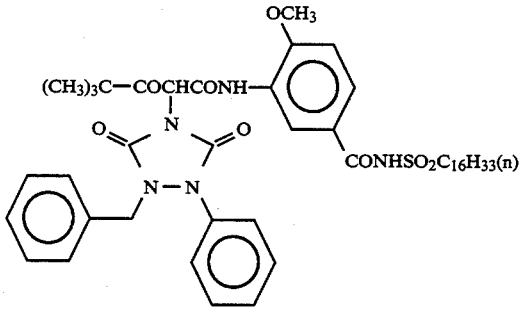

(4)

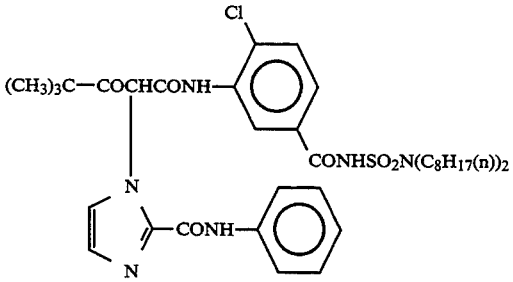

(5)

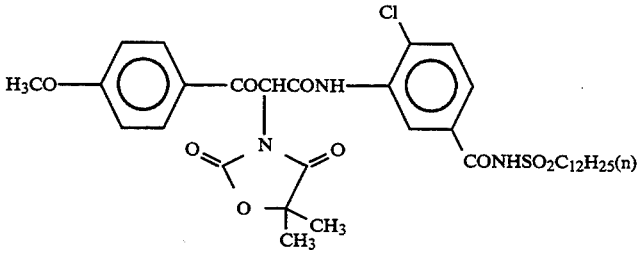

(6)

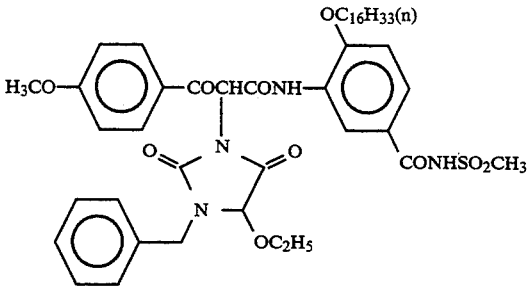

(7)

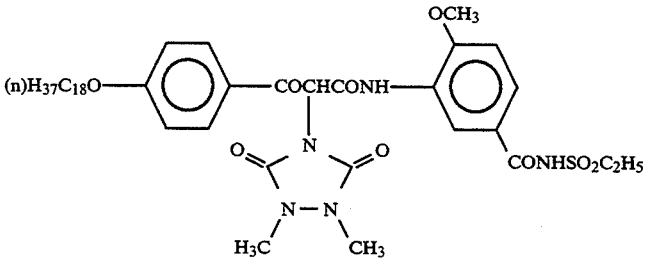

-continued
(8)
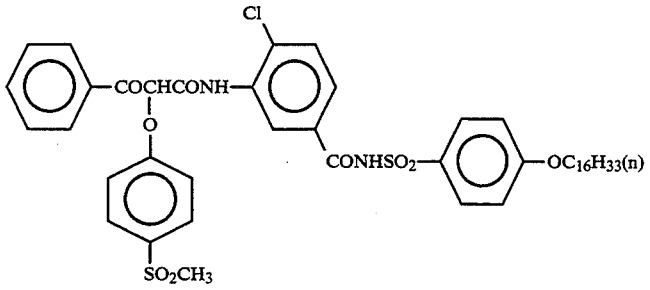
(9)
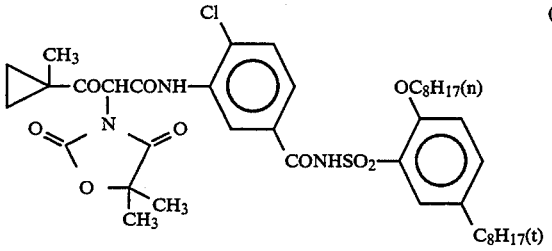
(10)
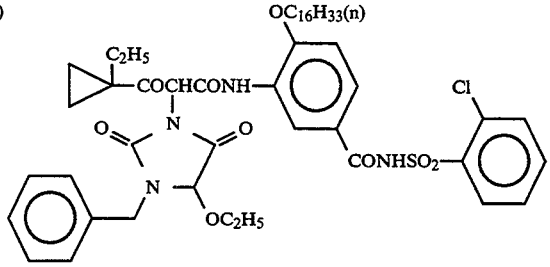
(11)
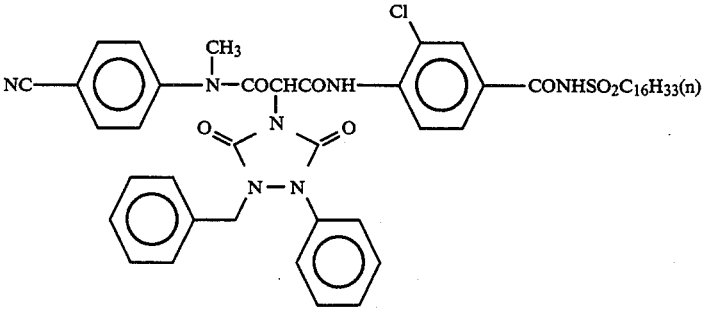
(12)
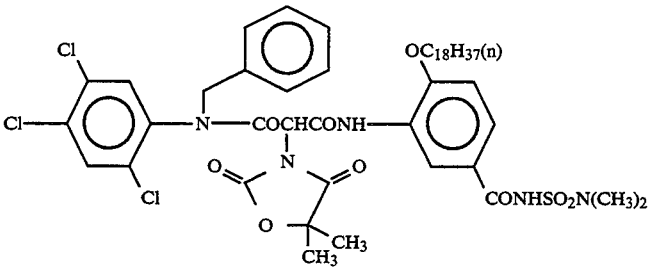
(13)
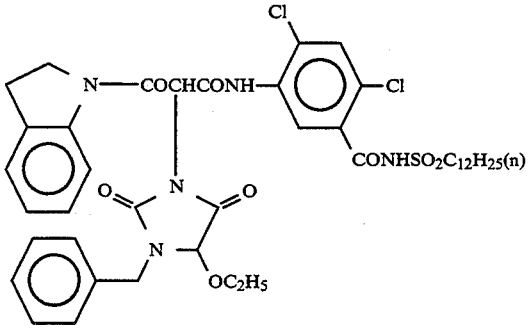
(14)
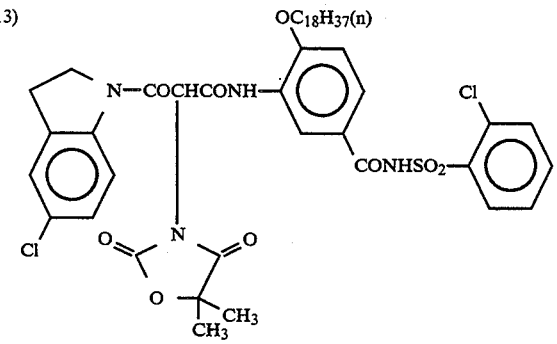

-continued
(15)
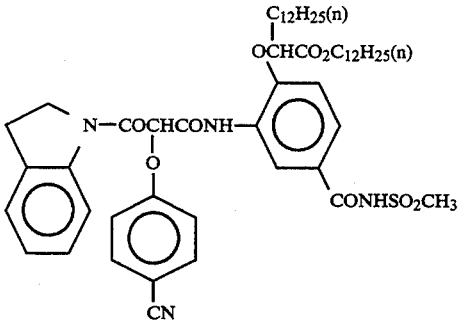
(16)
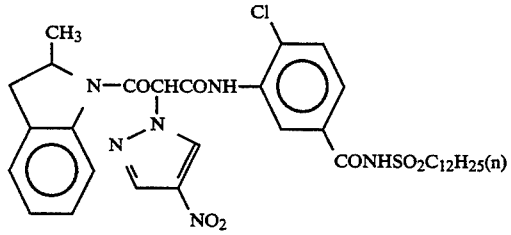
(17)
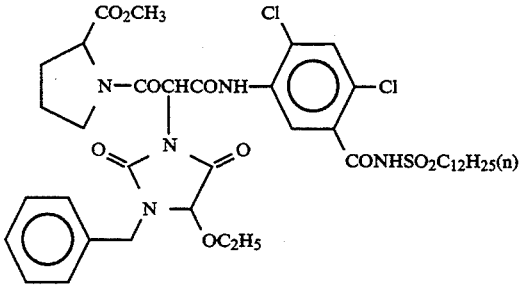
(18)
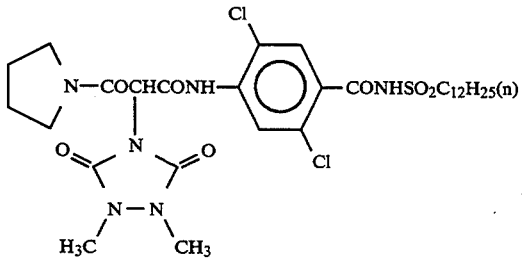
(19)
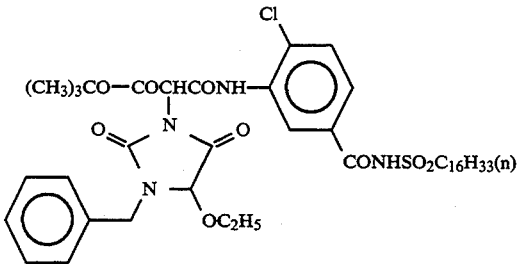
(20)
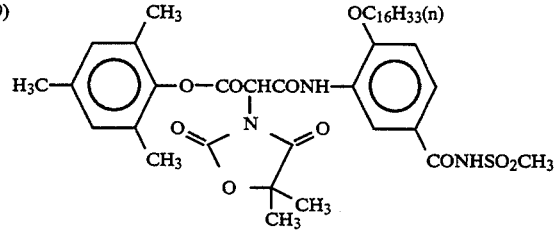
(21)
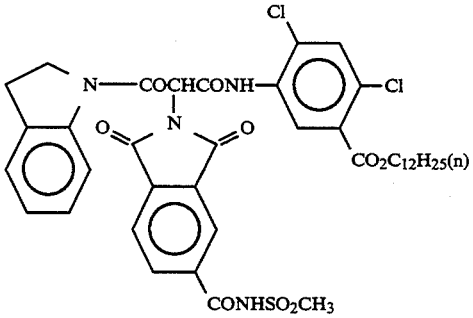
(22)
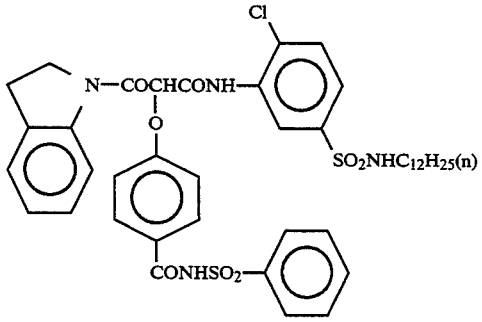
(23)
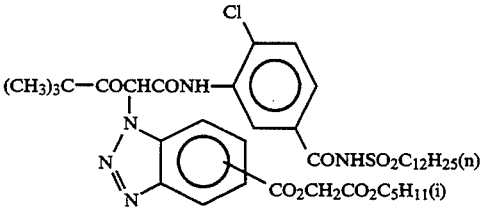
(24)
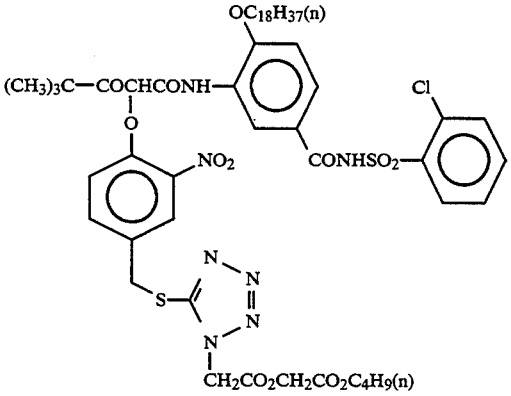

-continued
(25)
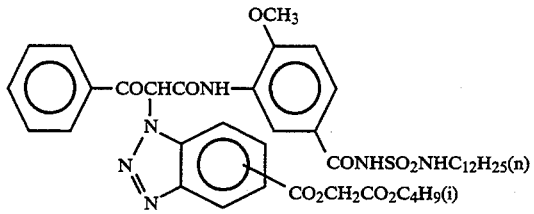
(26)
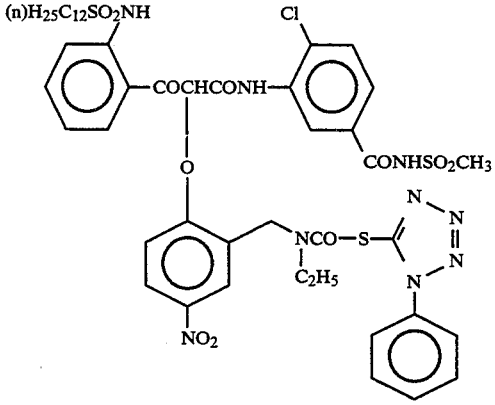
(27)
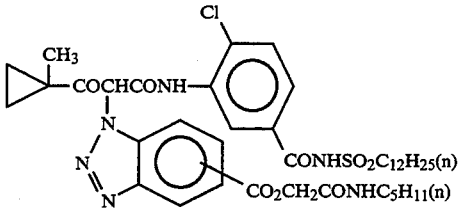
(28)
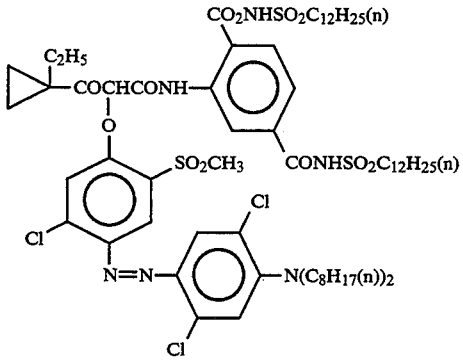
(29)
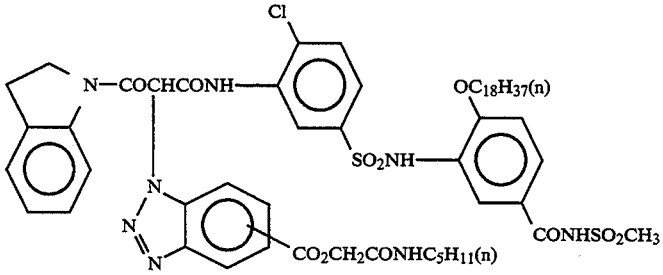
(30)
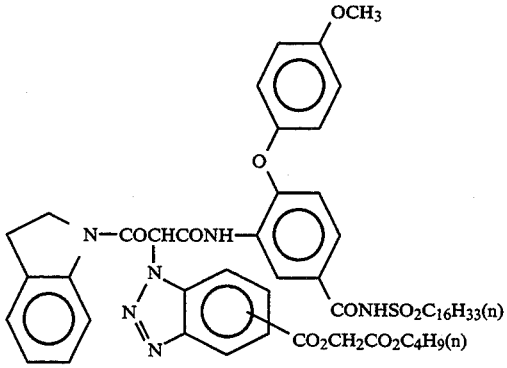
(31)
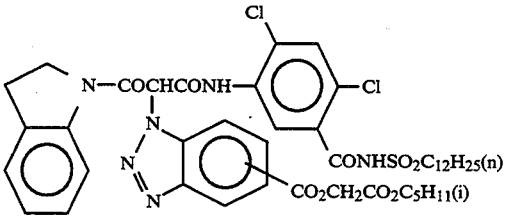

-continued
(32)
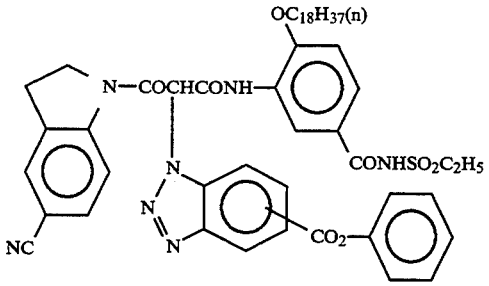
(33)
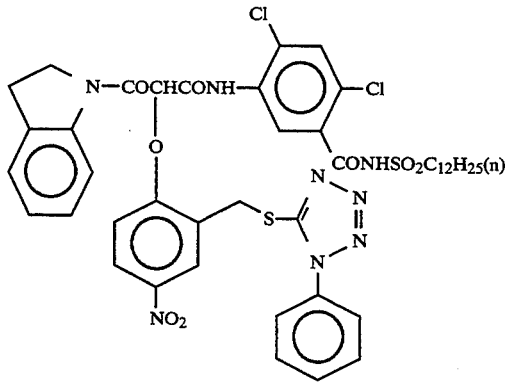
(34)
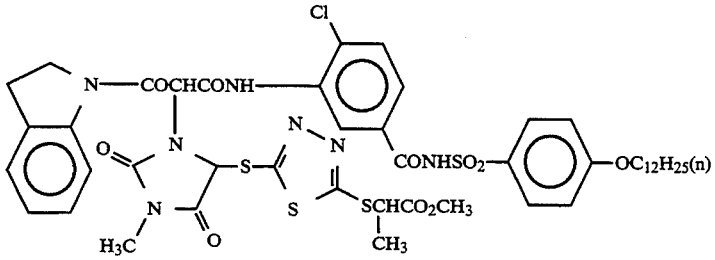
(35)
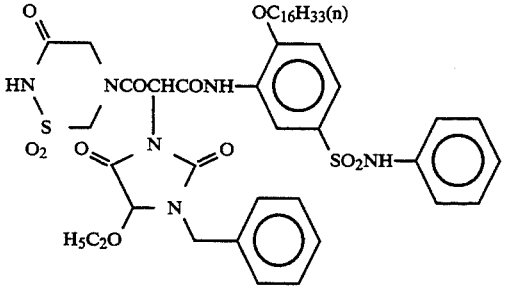
(36)
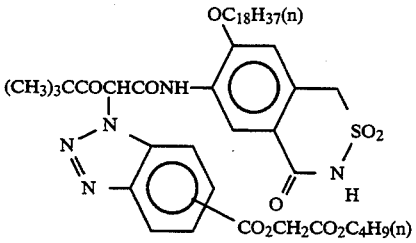
(37)
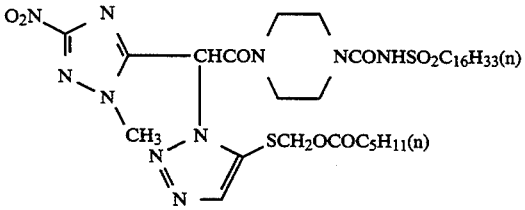
(38)
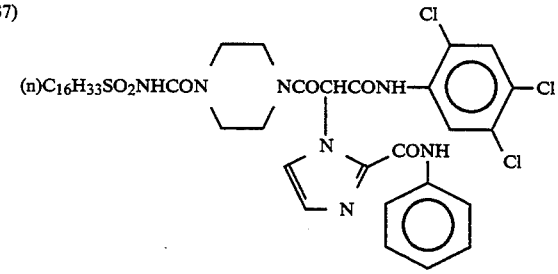
(39)
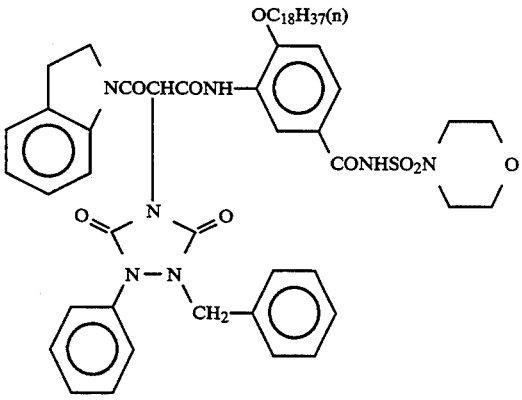
The synthesis of these compounds can be easily accomplished, e.g., by reacting a compound represented by general formula (II) or (III) with XH (in which X is as defined in general formula (I)) in the presence of a base.

$(R^1COCH(Br)CONR^2R^3)—(CONHSO_2R^4)_n$ (II)

$(R^1COCH(Cl)CONR^2R^3)—(CONHSO_2R^4)_n$ (III)

Examples of the synthesis of typical compounds of the present invention will be given below. Other compounds can be similarly synthesized.

SYNTHESIS EXAMPLE 1

Synthesis of Exemplary Compound (1)

Exemplary Compound (1) was prepared in accordance with the following synthesis process:

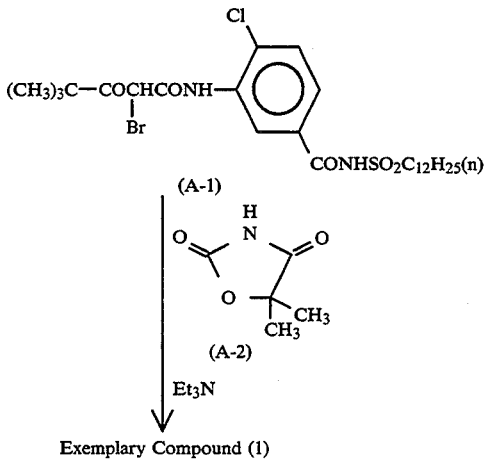

Exemplary Compound (1)

25.0 g of Compound (A-1) and 9.69 g of Compound (A-2) were mixed into 150 ml of N,N-dimethylacetamide with stirring at room temperature. 14.5 g of triethylamine was added dropwise to the material in 30 minutes. The admixture was then stirred for 2 hours. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 20.1 g of the desired exemplary compound (1) in the form of light yellow glassy solid.

SYNTHESIS EXAMPLE 2

Synthesis of Exemplary Compound (5)

Exemplary Compound (5) was prepared in accordance with the following synthesis process:

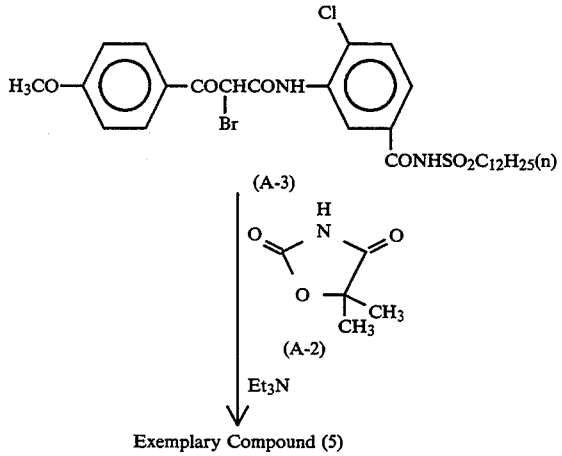

Exemplary Compound (5)

30.0 g of Compound (A-3) and 10.5 g of Compound (A-2) were mixed into 150 ml of N,N-dimethylacetamide with stirring at room temperature. 13.8 g of triethylamine was added dropwise to the material in 30 minutes. The admixture was then stirred for 1 hour. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 22.0 g of the desired exemplary compound (5) in the form of colorless oily matter.

SYNTHESIS EXAMPLE 3

Synthesis of Exemplary Compound (10)

Exemplary Compound (10) was prepared in accordance with the following synthesis process:

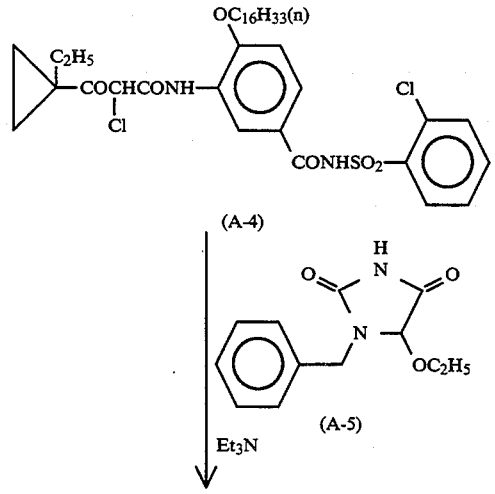

Exemplary Compound (10)

55.0 g of Compound (A-4) and 35.6 g of Compound (A-5) were mixed into 300 ml of N,N-dimethylacetamide with stirring at room temperature. 23.0 g of triethylamine was added dropwise to the material in 45 minutes. The admixture was then stirred for 3 hours. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 46.2 g of the desired exemplary compound (10) in the form of colorless oily matter.

SYNTHESIS EXAMPLE 4

Synthesis of Exemplary Compound (13)

Exemplary Compound (13) was prepared in accordance with the following synthesis process:

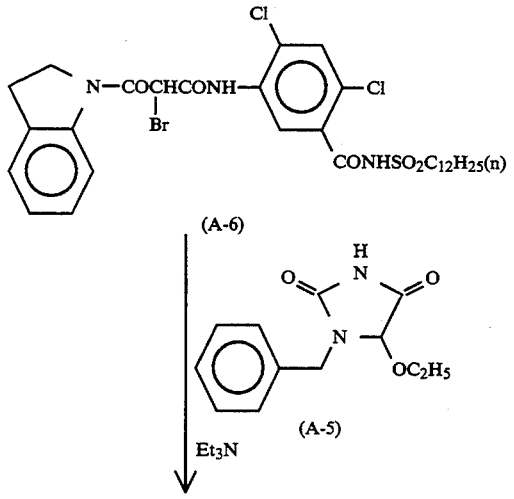

Exemplary Compound (13)

135 g of Compound (A-6) and 91.7 g of Compound (A-5) were mixed into 700 ml of N,N-dimethylacetamide with stirring at room temperature. 59.4 g of triethylamine was added dropwise to the material in 50 minutes. The admixture was then stirred for 3 hours. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 98.5 g of the desired exemplary compound (13) in the form of light yellow glassy solid.

SYNTHESIS EXAMPLE 5

Synthesis of Exemplary Compound (25)

Exemplary Compound (25) was prepared in accordance with the following synthesis process:

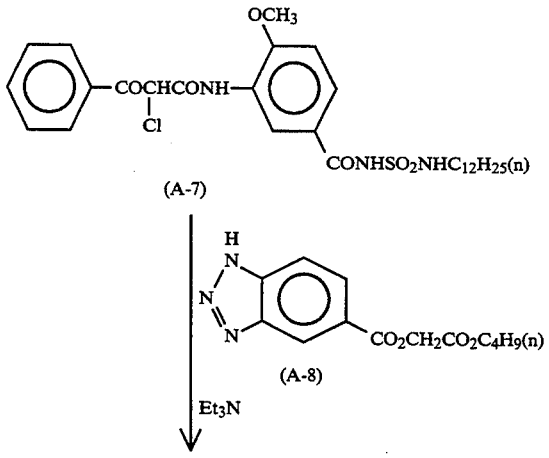

Exemplary Compound (25)

62.0 g of Compound (A-7) and 57.9 g of Compound (A-8) were mixed into 300 ml of N,N-dimethylacetamide with stirring at room temperature. 31.7 g of triethylamine was added dropwise to the material in 60 minutes. The admixture was then stirred for 3 hours. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 58.7 g of the desired exemplary compound (25) in the form of colorless oily matter.

SYNTHESIS EXAMPLE 6

Synthesis of Exemplary Compound (27)

Exemplary Compound (27) was prepared in accordance with the following synthesis process:

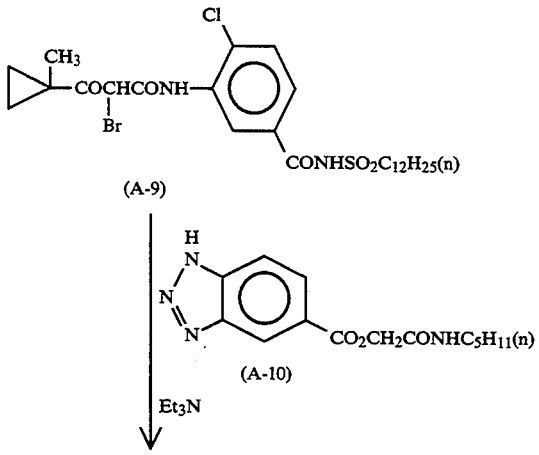

Exemplary Compound (27)

25.0 g of Compound (A-9) and 24.0 g of Compound (A-10) were mixed into 150 ml of N,N-dimethylacetamide with stirring at room temperature. 12.5 g of triethylamine was added dropwise to the material in 20 minutes. The admixture was then stirred for 1 hour. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 23.8 g of the desired exemplary compound (27) in the form of colorless oily matter.

SYNTHESIS EXAMPLE 7

Synthesis of Exemplary Compound (31)

Exemplary Compound (31) was prepared in accordance with the following synthesis process:

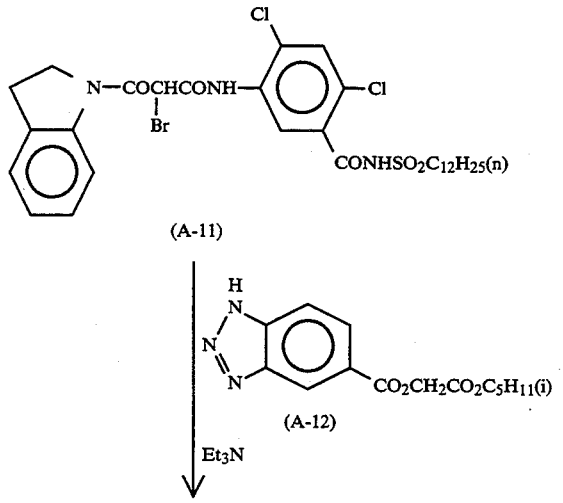

Exemplary Compound (31)

43.5 g of Compound (A-11) and 36.8 g of Compound (A-12) were mixed into 250 ml of N,N-dimethylacetamide with stirring at room temperature. 19.2 g of triethylamine was added dropwise to the material in 30 minutes. The admixture was then stirred for 1 hour. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 39.3 g of the desired exemplary compound (31) in the form of light yellow oily matter.

SYNTHESIS EXAMPLE 8

Synthesis of Exemplary Compound (32)

Exemplary Compound (32) was prepared in accordance with the following synthesis process:

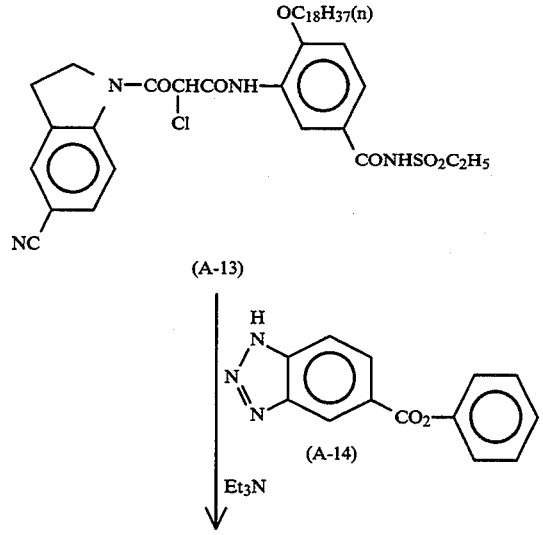

Exemplary Compound (32)

15.0 g of Compound (A-13) and 9.65 g of Compound (A-14) were mixed into 100 ml of N,N-dimethylacetamide with stirring at room temperature. 6.13 g of triethylamine was added dropwise to the material in 15 minutes. The admixture was then stirred for 1 hour. The reaction mixture was then poured into water. The material was then extracted with ethyl acetate. The organic phase thus extracted was washed with water, a 5% aqueous solution of sodium carbonate and then diluted hydrochloric acid, and then dried on magnesium sulfate. The drying agent was then filtered off. The solvent was then distilled off the filtrate to obtain a yellow oily matter. The material was then purified through a silica gel chromatography column to obtain 10.4 g of the desired exemplary compound (32) in the form of colorless glassy solid.

The coupler represented by general formula (I) may be used in an amount of $1.0\times10^{-3}$ to 1.0 mol, preferably $2.0\times10^{-2}$ to $5.0\times10^{-1}$ mol, more preferably $5.0\times10^{-2}$ to $4.0\times10^{-1}$ mol per mol of silver halide in a light-sensitive silver halide emulsion layer if the coupler is to be incorporated therein, or, in a light-sensitive silver halide emulsion layer adjacent to a light-insensitive layer if the coupler is to be incorporated in the light-insensitive layer (if the light-insensitive layer is interposed between two light-sensitive layers, the light-sensitive silver halide emulsion layer having a higher silver halide content is selected).

The present photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic materials comprise light-sensitive layers consisting of a plurality of silver halide emulsion layers having substantially the same color sensitivity and different light sensitivities on a support. The light-sensitive layers are unit light-sensitive layers having a color sensitivity to any one of a blue light, a green light and a red light. In the multi-layer silver halide color photographic material, these unit light-sensitive layers are normally arranged in the order of a red-sensitive layer, a green-sensitive layer and a blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers, such as various interlayers, can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038 (The term "JP-A" as used herein means an "unexamined published Japanese patent application"). These interlayers can further comprise a commonly used color stain inhibitor.

A plurality of silver halide emulsion layers can constitute each unit light-sensitive layer and preferably can be a two-layer structure, i.e., high sensitivity emulsion layer and low sensitivity emulsion layer, as described in West German Patent 1,121,470 and British Patent 923,045. In general, these layes are preferably arranged in such an order that the light sensitivity becomes lower towards the support. Furthermore, a light-insensitive layer can be provided between these silver halide emulsion layers. Also, as described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In one embodiment having such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) are arranged in this order remote from the support. In another embodiment, BH, BL, GL, GH, RH, and RL are arranged in this order remote from the support. In a further embodiment, BH, BL, GH, RL, and RH are arranged in this order remote from the support.

As described in JP-B-55-34932, a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used wherein the uppermost layer is the silver halide emulsion layer having the highest sensitivity, the middle layer is a silver halide emulsion layer having a lower sensitivity, and the lowermost layer is a silver halide emulsion layer having still a lower sensitivity than that of the middle layer. In such a layered arrangement, the light sensitivity becomes lower towards the support. Even where the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-202464.

Alternatively, a high sensitivity emulsion layer, a low sensitivity emulsion layer and a middle sensitivity emulsion layer, or, a low sensitivity emulsion layer, a middle sensitivity emulsion layer and a high sensitivity emulsion layer may be arranged in this order. In the case of four-layer structure, too, the arrangement of layers may be similarly altered.

In order to improve color reproducibility, a donor layer (CL) having an interimage effect and a different spectral sensitivity distribution from the main light-sensitive layers, such as BL, GL and RL, may be provided adjacent or close to these main layers as described in U.S. Pat. Nos. 4,663,271, 4,705,744, and 4,707,436, and JP-A-62-160448 and JP-A-63-89580.

As described above, various layer structures and arrangements can be selected depending on the purpose of the light-sensitive material.

A suitable silver halide to be incorporated in the photographic emulsion layer in the photographic light-sensitive materials of the present invention is silver iodobromide, silver iodochloride or silver iodochlorobromide containing silver iodide in an amount of about 30 mole % or less. Particularly suitable is silver iodobromide or silver iodochlorobromide containing silver iodide in an amount of about 2 mole % to about 10 mole %.

Silver halide grains in the present,invention emulsions may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains may be either fine grains of about 0.2 μm or smaller in diameter or giant grains having a projected area diameter of up to about 10 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December, 1978), pp. 22–23, "I. Emulsion Preparation and Types", No. 18716 (November, 1979), page 648, and No. 307105 (November, 1989), pp. 863–865, Glafkides, *Chimie et Physique Photographique,* Paul Montel (1967), G. F. Duffin, *Photographic Emulsion Chemistry,* Focal Press, 1966, and V. L. Zelikman et al., *Making and Coating Photographic Emulsion Focal Press.,* 1964.

Furthermore, monodisperse emulsions as described in U.S. Pat. Nos. 3,574,628 and 3,655,394, and British Patent 1,413,748 can be preferably used in the present invention.

Tabular grains having an aspect ratio of about 3 or more can be used in the present invention. The preparation of such tabular grains can be easily accomplished by any suitable method as described in Gutoff, *Photographic Science and Engineering,* vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc., by an epitaxial junction. Mixtures of grains having various crystal forms may also be used.

The above mentioned emulsion may be of the surface latent image type in which latent images are mainly formed on the surface of grains, or, they may be of the internal latent image type in which latent images are mainly formed inside grains, or, they may be of the type in which latent images are formed both on the surface and inside the grains. The emulsion needs to be a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, the thickness of the shell depends on development process, etc., and is preferably in the range of 3 to 40 nm, particularly 5 to 20 nm.

The silver halide emulsion to be used in the present invention is normally subjected to physical ripening, chemical ripening and spectral sensitization. Additives to be used in these steps are described in *Research Disclosure* Nos. 17643 and 18716 as tabulated below.

In the light-sensitive material of the present invention, two or more kinds of light-sensitive halide emulsions which are different in at least one characteristic selected from the group consisting of grain size, grain size distribution, halogen composition, grain shape and sensitivity, may be incorporated in the same layer in admixture.

Surface-fogged silver halide grains as described in U.S. Pat. No. 4,082,553, internally-fogged silver halide grains as described in U.S. Pat. No. 4,626,498 and JP-A-59-214852, or colloidal silver may be preferably incorporated in a light-sensitive silver halide emulsion layer and/or a substantially light-insensitive hydrophilic colloidal layer. The term "internally- or surface-fogged silver halide grains" as used herein means "silver halide grains which can be uniformly (nonimagewise) developed regardless of whether they were present in the exposed portion or unexposed portion on the light-sensitive material". Processes for the preparation of internally- or surface-fogged silver halide grains are described in U.S. Pat. No. 4,626,498, and JP-A-59-214852.

Silver halides forming the core of internally-fogged core/shell type silver halide grains may have the same or different halogen compositions. Internally- or surface-fogged silver halide grains may comprise any of silver chloride, silver chlorobromide, silver iodobromide and silver chloroiodobromide. The size of these fogged silver halide grains is not specifically limited, and their average grain size is preferably in the range of 0.01 to 0.75 μm, particularly 0.05 to 0.6 μm. The crystal form of these grains is not specifically limited and may be regular. These emulsions may be polydisperse but are preferably monodisperse (silver halide grains wherein at least 95% by weight or number of the grains have grain diameters falling within ±40% from the average grain size).

In the present invention, light-insensitive finely divided silver halide grains are preferably used. Light-insensitive finely divided silver halide grains are silver halide grains which are not exposed to light upon imagewise exposure for making dye images so that they are not substantially developed at development process. Preferably, these silver halide grains are not previously fogged.

These finely divided silver halide grains have a silver bromide content of 0 to 100 mole % and may optionally contain silver chloride and/or silver iodide, preferably 0.5 to 10 mole % of silver iodide.

These finely divided silver halide grains preferably have an average grain diameter of 0.01 to 0.5 μm, more preferably 0.02 to 0.2 μm as calculated in terms of diameter of a circle having the same area as the projected area of grain.

These finely divided silver halide grains can be prepared in the same manner as ordinary light-sensitive silver halide. In this case, the surface of the silver halide grains need be neither optically nor spectrally sensitized. However, prior to the addition of the emulsion to a coating solution, a known additive such as triazole, azaindene, benzothiazolium, a mercapto compound and a zinc compound is preferably added to the emulsion. Colloidal silver is preferably incorporated in the layer containing these finely divided silver halide grains.

The coated amount of silver in the light-sensitive material of the present invention is preferably in the range of 6.0 g/m$^2$ or less, most preferably 4.5 g/m$^2$ or less.

Known photographic additives which can be used in the present invention are also described in the above cited three *Research Disclosures* as tabulated below.

| Kind of additive | RD17643 | RD18716 | RD307105 |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and supersensitizer | pp. 23–24 | p. 648 RC-p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 left column (LC) | p. 873 |
| 7. Stain inhibitor | p. 25 RC | p. 650 LC-RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material of the present invention preferably comprises a mercapto compound as disclosed in U.S. Pat. Nos. 4,740,454, and 4,788,132, and JP-A-62-18539, and JP-A-1-283551.

The light-sensitive material of the present invention preferably comprises a fogging agent, a development accelerator, a silver halide solvent or a compound for releasing precursors thereof as disclosed in JP-A-1-106052 regardless of the amount of developed silver produced by development.

The light-sensitive material of the present invention preferably comprises a dye which has been dispersed by a method as disclosed in International Patent Disclosure WO88/04794 and JP-A-1-502912 or a dye as disclosed in EP 317 308 A, U.S. Pat. No. 4,420,555, and JP-A-1-259358.

The light-sensitive material to be processed in the present invention can comprise various color couplers. Specific examples of the color couplers are described in the patents described in the above cited *Research Disclo-*

*sure* No. 17643, VII-C to G, and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649; JP-B-58-10739; British Patents 1,425,020 and 1,476,760; and European Patent 249 473 A. The yellow couplers can be used in combination with the compound represented by general formula (I).

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, 4,540,654, and 4,556,630; European Patent 73 636; JP-A-60-33552, JP-A-60-43659, JP-A-61-72238, JP-A-60-35730, JP-A-55-118034, and JP-A-60-185951; RD Nos. 24220 (June, 1984) and 24230 (June, 1984); and WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199; West German Patent (OLS) No. 3,329,729; European Patents 121 365 A and 249 453 A; and JP-A-61-42658. Further, pyrazoloazole couplers as disclosed in JP-A-64-553, JP-A-64-554, JP-A-64-555, and JP-A-64-556 and imidazole couplers as disclosed in U.S. Pat. No. 4,818,672 can be used.

Typical examples of polymerized dye-forming couplers are described in U.S. Pat. Nos. 3,451,820, 4,080,211, 4,367,282, 4,409,320, and 4,576,910, British Patent 2,102,173, and European Patent 341 188 A.

Couplers which form a dye having moderate diffusibility preferably include those described in U.S. Pat. No. 4,366,237, British Patent 2,125,570, European Patent 96 570, and West German Patent (OLS) No. 3,234,533.

Colored couplers for correction of unnecessary absorptions of the developed dye preferably include those described in *Research Disclosure* No. 17643, VII-G, *Research Disclosure* No. 307105, VII-G, U.S. Pat. Nos. 4,163,670, 4,004,929, and 4,138,258; JP-B-57-39413; and British Patent 1,146,368. Furthermore, couplers for correction of unnecessary absorption of the developed dye by a fluorescent dye released upon coupling can be preferably used as described in U.S. Pat. No. 4,774,181; and couplers containing as a separatable group a dye precursor group capable of reacting with a developing agent to form a dye as described in U.S. Pat. No. 4,777,120 can be preferably used.

Compounds capable of releasing a photographically useful residue upon coupling can also be used in the present invention. Preferred examples of DIR couplers which release a development inhibitor are described in the patents cited in RD 17643, VII-F, and in JP-A-57-151944, JP-A-57-154234, JP-A-60-184248, JP-A-63-37346, and JP-A-63-37350, and U.S. Pat. Nos. 4,248,962, and 4,782,012.

Bleach accelerator-releasing couplers as disclosed in RD Nos. 11449, and 24241, and JP-A-61-201247 are effective for reducing the time required for processing steps having bleaching capabilities. In particular, when incorporated in a light-sensitive material comprising the above mentioned tabular silver halide grains, these couplers exhibit their maximum effects.

Couplers capable of imagewise releasing a nucleating agent or a developing accelerator at the time of development preferably include those described in British Patents 2,097,140 and 2,131,188; and JP-A-59-157638 and JP-A-59-170840. Further, compounds which undergo redox reaction with the oxidation product of a developing agent to release a fogging agent, a development accelerator, a silver halide solvent or the like as disclosed in JP-A-60-107029, JP-A-60-252340, JP-A-1-44940, and JP-A-1-45687 are preferred.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound-releasing couplers, DIR coupler-releasing couplers, DIR coupler-releasing redox compounds, or DIR redox-releasing redox compounds as described in JP-A-60-185950 and JP-A-62-24252, couplers capable of releasing a dye which returns to its original color after release as described in European Patents 173 302 A and 313 308 A, couplers capable of releasing a ligand as described in U.S. Pat. No. 4,555,477, couplers capable of releasing a leuco dye as described in JP-A-63-75747, and couplers capable of releasing a fluorescent dye as described in U.S. Pat. 4,774,181.

The incorporation of the couplers of the present invention in the light-sensitive material can be accomplished by any suitable known dispersion method.

Examples of high boiling solvents that can be used in an oil-in-water dispersion process are described in U.S. Pat. No. 2,322,027. Specific examples of high boiling organic solvents having a boiling point of 175° C. or higher at normal pressure which can be used in an oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of a latex dispersion method and specific examples of latexes to be used in dipping are described in U.S. Pat. No. 4,199,363, West German Patent (OLS) Nos. 2,541,274, and 2,541,230.

The color light-sensitive material of the present invention preferably comprises various antiseptics or antifungal agents such as phenethyl alcohol and 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941.

The present invention is applicable to various types of color light-sensitive materials, particularly preferably to color negative films for common use or motion picture use, color reversal films for slide use or television use, color papers, color positive films and color reversal papers.

Suitable supports which can be used in the present invention are described in the above cited RD 17643 (page 28), No. 18716 (right column on page 647 to left column on page 648), and No. 307105 (page 897).

In the present light-sensitive material, the total thickness of all hydrophilic colloidal layers on the emulsion side is preferably in the range of 28 μm or less, more preferably 23 μm or less, further preferably 18 μm or less, particularly 16 μm or less. The film swelling $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling $T_{\frac{1}{2}}$ can be determined by a method known in the art, e.g., by means of a swellometer of the type as described in A. Green et al., *Photographic Science and Engineering, vol.* 19, No. 2, pp. 124–129. $T_{\frac{1}{2}}$ is defined as the time taken until half the saturated film thickness is reached, wherein the saturated film thickness is 90% of the maximum swollen film thickness reached when the light-sensitive material is processed with a color developer at a temperature of 30° C. over 195 seconds.

The film swelling $T_{\frac{1}{2}}$ can be adjusted by adding a film hardener to gelatin as a binder or by altering ageing conditions after coating. The percentage of swelling of the light-sensitive material is preferably in the range of 150 to 400%. The percentage of swelling can be calculated from the maximum swollen film thickness determined as described above in accordance with the equation: (maximum swollen film thickness film − thickness)-/film thickness.

The light-sensitive material of the present invention preferably comprises a hydrophilic colloid layer (hereinafter referred to as "back layer") having a total dried thickness of 2 μm to 20 μm on the other side to the emulsion layer side. The back layer preferably contains the above mentioned light absorbent, filter dye, ultraviolet absorbent, antistatic agent, film hardener, binder, plasticizer, lubricant, coating aid, surface active agent, etc. The back layer preferably exhibits a percentage of swelling of 150 to 500%.

The color photographic light-sensitive material according to the present invention can be developed in accordance with any ordinary method as described in RD Nos. 17643 (pp. 28–29), 18716 (left column - right column on page 651) and 307105 (pp. 880–881).

The color developer to be used in the development of the present light-sensitive material is preferably an alkaline aqueous color developer containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl-)aniline, 4-amino-3-methyl-N,N-bis(4-hydroxybutyl-)aniline, 4-amino-3-methyl-N, N-bis(5-hydroxypentyl-)aniline, 4-amino-3-methyl-N- (5-hydroxypentyl)-N-(4-hydroxybutyl)aniline, 4-amino-3-methoxy-N-ethyl-N-(4hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides and p-toluenesulfonates thereof. Particularly preferred among these compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates thereof. These compounds can be used in combination of two or more thereof depending on the purpose of application.

The color developer normally contains a pH buffer such as a carbonate, a borate and a phosphate of an alkaline metal or development inhibitors or fog inhibitors such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, dye-forming couplers, competing couplers, auxiliary developing agents such as 1-phenyl-3-pyrazolidone, viscosity-imparting agents, various chelating agents exemplified by aminopolycarboxylic acids, aminopolyphosphoric acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N′,N′-tetramethylenephosphonic acid, and ethylenediamine-di(o-hydroxyphenylacetic acid), and salts thereof).

Reversal processing is usually carried out by black-and-white development followed by color development. Black-and-white developers to be used can contain one or more of known black-and-white developing agents, such as dihydroxybenzenes, e.g., hydroquinone; 3-pyrazolidones, e.g., 1-phenyl-3-pyrazolidone; and aminophenols, e.g., N-methyl-p-aminophenol. The color developer or black-and-white developer usually has a pH of from 9 to 12. The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening value as defined by the following equation:

Opening value=[area of processing solution in contact with air ($cm^2$)/volume of processing solution ($cm^3$)]

The opening value as defined above is preferably in the range of 0.1 or less, more preferably 0.001 to 0.05. Examples of methods for reducing the opening value include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing accumulation of the bromide ion in the developing solution.

The color processing time is normally in the range of 2 to 5 minutes. The processing time can be further reduced by carrying out color development at an elevated temperature and a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, an embodiment wherein two blix baths connected in series are used, an embodiment wherein blix is preceded by fixation, or an embodiment wherein blix is followed by bleach may be selected arbitrarily according to the purpose. Bleaching agents which can be used include compounds of polyvalent metals, e.g., iron (III), peroxides, quinones, and nitro compounds. Typical examples of these bleaching agents are organic complex salts of iron (III), e.g., with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetate)iron (III) complex salts and (1,3-diaminopropanetetraacetate)iron (III) complex salts are preferred in view of their effects in speeding up of processing and conservation of the environment. In particular, aminopolycarboxylic acid-iron (III) complex salts are useful in both a bleaching solution and a blix solution. The pH value of a bleaching solution or blix solution comprising such an aminopolycarboxylic acid-iron complex salt is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include: compounds containing a mercapto group or a disulfide group as described in U.S. Pat. No. 3,893,858, West German Patents 1,290,812, and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July, 1978); thiazolidine derivatives as described in JP-A-50-140129; thiourea derivatives as described in JP-B-45-8506, JP-A-52-20832 and JP-A-53-32735, and U.S. Pat. No. 3,706,561; iodides as described in West German Patent 1,127,715 and JP-A-58-16235; polyoxyethylene compounds as described in West German Patents 966,410 and 2,748,430; polyamine compounds as described in JP-B-45-8836; compounds as described in JP-A-49-40943, JP-A-49-59644, JP-A-53-94927, JP-A-54-35727, JP-A-55-26506, and JP-A-58-163940; and bromine ions. Preferred among these compounds are compounds containing a mercapto group or disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix with respect to color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc., are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294 769 A. The fixing solution or blix solution preferably contains aminopolycarboxylic acids or organic phosphonic acids for the purpose of stabilizing the solution.

In the present invention, the fixing solution or blix solution preferably contains a compound with a pKa of 6.0 to 9.0, more preferably imidazoles such as imidazole, 1-methylimidazole, 1-ethylimidazole and 2-methylimidazole in an amount of 0.1 to 10 mol/l for the purpose of adjusting pH.

The total time required for a desilvering step is preferably as short as possible, providing that no mal-desilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include: a method as described in JP-A-183460 which comprises jetting the processing solution to the surface of the emulsion layer in the light-sensitive material; a method as described in JP-A-62-183461 which comprises improving the agitating effect by a rotary means; a method which comprises improving the agitating effect by moving the light-sensitive material with the emulsion surface in contact with a wiper blade provided in the bath so that a turbulence occurs on the emulsion surface; and a method which comprises increasing the total circulated amount of processing solution. Such agitation improving methods can be effectively applied to the bleaching bath, blix bath or fixing bath. An improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing caused by the bleach accelerator.

An automatic developing machine if used in the processing of the light-sensitive material of the present invention is preferably equipped with a light-sensitive material conveying means as disclosed in JP-A-60-191257, JP-A-60-191258, and JP-A-60-191259. Such a conveying means can remarkably reduce the amount of the processing solution carried from a bath to its subsequent bath, thus providing a high inhibiting effect on a deterioration in the properties of the processing solution. This latter effect is also remarkably effective since it allows for a reduction in the processing time, and the amount of replenisher required at each step.

Usually a desilvered silver halide color photographic material of the invention is subjected to a washing and/or stabilization. The quantity of water used in the washing can be selected from a broad range depending on the characteristics of the light-sensitive material (for example, the kind of couplers present, etc.), the end use of the light-sensitive material, the temperature of the washing water, the number of washing tanks (number of stages), the replenishment system (e.g., counter-flow system or forward-flow system), and other various factors. Of these factors, the relationship between the number of washing tanks and the quantity of water in a multistage counter-flow system can be obtained according to the method described in *Journal of the Society of Motion Picture and Television Engineers,* vol. 64, pp. 248–253 (May, 1955).

According to the multi-stage counter-flow system described in the above reference, although the requisite amount of water can be greatly reduced, bacteria can grow due to an increase of the retention time of water in the tank, and floating masses of bacteria can stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, *Bokinbobaizai no kagaku* (1986), Eisei Gijutsu Gakkai (ed.), *Biseibutsu no mekkin, sakkin, bobigijutsu* (1982), and Nippon Bokin Bobi Gakkai (ed.), Bokin bobizai jiten (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. For example, a stabilizing bath containing a dye stabilizer and a surface active agent can be used as a final bath for color light-sensitive materials for picture taking. Examples of such a dye stabilizer include aldehydes such as formalin and glutaraldehyde, N-methylol compounds, hexamethylenetetramine, and aldehyde-bisulfite adducts. Such a stabilizing bath may also contain various chelating agents or antifungal agents.

The overflow accompanying replenishment of the washing bath and/or stabilizing bath can be reused in other steps such as desilvering.

In a process using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure* Nos. 14850 and 15159, and aldol compounds as described in *Research Disclosure* No. 13924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

The silver halide color photographic material according to the present invention can be applied to a film unit with a lens as disclosed in JP-B-2-32615, and JP-B-U-3-39784 (The term "JP-B-U" as used herein means an "examined Japanese utility model publication") to make an easy exhibition of its effects.

The present invention will be further described in the following examples, but the present invention should not be construed as being limited thereto.

EXAMPLE 1

A light-sensitive material was prepared as Specimen 101 by coating on an undercoated triacetyl cellulose film support various layers having the following compositions:

| | |
|---|---|
| (1) Emulsion layer | |
| Emulsion of tabular silver halide grains (silver iodide content: 4 mol %; average aspect ratio: 7.5; average grain diameter: 1.10 μm) | 1.00 g/m² in terms of silver |
| Comparative coupler C-1 | 0.90 g/m² |
| Tricresyl phosphate | 0.25 g/m² |
| Gelatin | 2.80 g/m² |
| (2) Protective layer | |
| Sodium 2,4-dichloro-6-hydroxy-s-triazine | 0.10 g/m² |
| Gelatin | 1.80 g/m² |

Specimens 102 to 104 were prepared in the same manner as Specimen 101, except that Comparative Coupler C-1 to be incorporated in the emulsion layer was replaced by the couplers as set forth in Table 1 in the equimolecular amount, respectively.

These specimens were each exposed to white light for sensitometry, and then subjected to color development as described later. The specimens thus developed were each measured for yellow density. From the measurements, the relative sensitivity represented by the logarithm of reciprocal of the exposure giving a density of (fog+0.2), the maximum color density and γ (gradient of the straight line between the point of (fog+0.2) and the point of (fog+1.2)) were determined. The results are set forth in Table 1.

TABLE 1

| Specimen | Coupler | Relative sensitivity | γ | Maximum color density |
|---|---|---|---|---|
| 101 (comparative) | C-1 | 0.00 | 0.57 | 1.42 |
| 102 (comparative) | C-2 | 0.12 | 0.78 | 1.84 |
| 103 (present invention) | (6) | 0.20 | 0.95 | 2.00 |
| 104 (present invention) | (7) | 0.18 | 0.93 | 1.97 |

As shown in Table 1, the specimens according to the present invention exhibit a higher sensitivity, a higher contrast and a higher color density than the comparative specimens, thus showing the effectiveness of the present invention.

Processing Method

| Step | Processing time | Processing temperature |
|---|---|---|
| Color development | 2 min. 15 sec. | 38° C. |
| Bleach | 1 min. 00 sec. | 38° C. |
| Blix | 3 min. 15 sec. | 38° C. |
| Rinse (1) | 40 sec. | 35° C. |
| Rinse (2) | 1 min. 00 sec. | 35° C. |
| Stabilization | 40 sec. | 38° C. |
| Drying | 1 min. 15 sec. | 55° C. |

The composition of the various processing solutions will be given below.

| | (unit: g) |
|---|---|
| Color developer | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |

-continued

| | (unit: g) |
|---|---|
| 4-[N-ethyl-N-β-hydroxyethylamino]-2-methylaniline sulfate | 4.5 |
| Water to make | 1.0 l |
| pH | 10.05 |
| Bleaching solution | |
| Ferric ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleach accelerator $(CH_3)_2N—CH_2—CH_2—S—S—CH_2—CH_2—N(CH_3)_2.2HCl$ | 0.005 mol |
| 27% Aqueous ammonia | 15.0 ml |
| Water to make | 1.0 l |
| pH | 6.3 |
| Blix solution | |
| Ferric ammonium ethylenediaminetetraacetate dihydrate | 50.0 |
| Disodium ethylenediaminetetraacetate | 5.0 |
| Sodium sulfite | 12.0 |
| Aqueous solution of ammonium thiosulfate (700 g/l) | 240.0 ml |
| 27% Aqueous ammonia | 6.0 ml |
| Water to make | 1.0 l |
| pH | 7.2 |

Rinsing Solution

Tap water was passed through a mixed bed column filled with an H type strongly acidic cation exchange resin (Amberlite IR-120B produced by Rohm & Haas) and an OH type anion exchange resin (Amberlite IR-400) so that the calcium and magnesium ion concentrations were each reduced to 3 mg/l or less. To the solution were then added 20 mg/l of dichlorinated sodium isocyanurate and 150 mg/l of sodium sulfate. The pH range of the solution was from 6.5 to 7.5.

| | (unit: g) |
|---|---|
| Stabilizing solution | |
| Sodium p-toluenesulfinate | 0.03 |
| Polyoxyethylene-p-monononyl phenyl ether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl) piperazine | 0.75 |
| Water to make | 1.0 l |
| pH | 8.5 |

EXAMPLE 2

A light-sensitive material was prepared as Specimen 201 in the same manner as Specimen 101, except that the emulsion of tabular grains to be incorporated in the emulsion layer was replaced by a monodisperse emulsion of octahedral grains (silver iodide content: 11 mol %; core/shell grain with core proportion of 20 mol % and shell proportion of 2 mol %; average grain diameter: 0.34 μm; grain diameter fluctuation coefficient: 0.14) in an amount of 0.50 g/m² as calculated in terms of silver and Coupler C-1 was replaced by Coupler C-3.

Specimen 202 to 206 were prepared in the same manner as Specimen 201, except that Coupler C-3 was replaced by the couplers as set forth in Table 2 in the equimolecular amount, respectively.

These specimens were evaluated in the same manner as in Example 1. The results of photographic properties are set forth in Table 2.

TABLE 2

| Specimen | Coupler | Relative sensitivity | γ | Maximum color density |
|---|---|---|---|---|
| 201 (comparative) | C-3 | 0.00 | 1.12 | 1.89 |
| 202 (comparative) | C-4 | 0.00 | 1.16 | 1.95 |
| 203 (present invention) | (1) | 0.05 | 1.31 | 2.16 |
| 204 (present invention) | (2) | 0.04 | 1.29 | 2.16 |
| 205 (present invention) | (3) | 0.04 | 1.30 | 2.15 |
| 206 (present invention) | (4) | 0.03 | 1.26 | 2.14 |

Table 2 shows that the specimens comprising the couplers of the present invention exhibit a high sensitivity, a high contrast and a high maximum color density.

EXAMPLE 3

A light-sensitive material was prepared as Specimen 301 in the same manner as Specimen 201, except that Coupler C-3 (0.90 g/m$^2$) was replaced by Coupler C-2 (0.80 g/m$^2$) and tricresyl phosphate (0.25 g/m$^2$) was replaced by dibutyl phthalate (0.20 g/m$^2$).

Specimen 302 to 305 were prepared in the same manner as Specimen 301, except that Coupler C-2 was replaced by the couplers as set forth in Table 3 in the equimolecular or semimolecular amount, respectively.

These specimens were evaluated in the same manner as in Example 1. The results are set forth in Table 3.

TABLE 3

| Specimen | Coupler | Relative sensitivity | γ | Maximum color density |
|---|---|---|---|---|
| 301 (comparative) | C-2 | 0.00 | 1.08 | 1.92 |
| 302 (present invention) | (9) | 0.02 | 1.26 | 2.31 |
| 303 (present invention) | (13) | 0.02 | 1.30 | 2.34 |
| 304 (present invention) | C-2/(9) | 0.01 | 1.20 | 2.16 |
| 305 (present invention) | C-2/(13) | 0.01 | 1.22 | 2.18 |

Table 3 shows that the specimens comprising the couplers of the present invention exhibit a high contrast as well as a high color density.

EXAMPLE 4

A multi-layer color light-sensitive material was prepared as Specimen 401 by coating on an undercoated cellulose triacetate film support various layers having the following compositions:

Composition of Light-Sensitive Layer

Materials to be incorporated in the various layers are classified into the following categories:

ExC: cyan coupler; ExM: magenta coupler; ExY: yellow coupler; ExF: dye; ExS: sensitizing dye; UV: ultraviolet absorbent; HBS: high boiling organic solvent; H: gelatin hardener.

The coated amount of silver halide and colloidal silver is represented in g/m$^2$ as calculated in terms of silver. The coated amount of coupler, additive and gelatin is represented in g/m$^2$. The coated amount of sensitizing dye is represented in the number of moles per mole of silver halide in the same layer.

| | |
|---|---|
| **1st layer: antihalation layer** | |
| Black colloidal silver | 0.15 |
| Gelatin | 1.00 |
| ExM-1 | $2.0 \times 10^{-2}$ |
| HBS-1 | $3.0 \times 10^{-2}$ |
| **2nd layer: interlayer** | |
| Gelatin | 0.90 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| HBS-2 | $7.0 \times 10^{-2}$ |
| **3rd layer: low sensitivity red-sensitive emulsion layer** | |
| Emulsion A | 0.15 in terms of silver |
| Emulsion B | 0.25 in terms of silver |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| HBS-1 | $7.0 \times 10^{-3}$ |
| **4th layer: middle sensitivity red-sensitive emulsion layer** | |
| Emulsion C | 0.25 in terms of silver |
| Emulsion D | 0.45 in terms of silver |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| Coupler C-5 | $2.0 \times 10^{-2}$ |
| ExY-2 | $1.0 \times 10^{-2}$ |
| Cpd-10 | $1.0 \times 10^{-4}$ |
| HBS-1 | 0.10 |
| **5th layer: high sensitivity red-sensitive emulsion layer** | |
| Emulsion E | 0.60 in terms of silver |
| Gelatin | 1.20 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| ExC-7 | $1.5 \times 10^{-2}$ |
| HBS-1 | $8.0 \times 10^{-2}$ |
| HBS-2 | $8.0 \times 10^{-2}$ |
| **6th layer: interlayer** | |
| Gelatin | 0.60 |
| P-2 | 0.17 |
| Cpd-1 | 0.10 |
| Cpd-4 | 0.17 |
| HBS-1 | $5.0 \times 10^{-2}$ |
| **7th layer: low sensitivity green-sensitive emulsion layer** | |
| Emulsion F | 0.10 in terms of silver |
| Emulsion G | 0.15 in terms of silver |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| Coupler C-5 | $3.0 \times 10^{-2}$ |
| Cpd-11 | $7.0 \times 10^{-3}$ |
| HBS-1 | 0.20 |
| **8th layer: middle sensitivity green-sensitive emulsion layer** | |
| Emulsion H | 0.55 in terms of silver |
| Gelatin | 0.80 |
| ExS-4 | $5.0 \times 10^{-4}$ |

-continued

| | |
|---|---|
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $1.5 \times 10^{-2}$ |
| Coupler C-5 | $4.0 \times 10^{-2}$ |
| Cpd-11 | $9.0 \times 10^{-3}$ |
| HBS-1 | 0.20 |
| 9th layer: high sensitivity green-sensitive emulsion layer | |
| Emulsion I | 0.45 in terms of silver |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Coupler C-5 | $2.0 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| HBS-1 | 0.20 |
| HBS-2 | $5.0 \times 10^{-2}$ |
| 10th layer: yellow filter layer | |
| Gelatin | 0.60 |
| Yellow colloid | $5.0 \times 10^{-2}$ |
| Cpd-1 | 0.20 |
| HBS-1 | 0.15 |
| 11th layer: low sensitivity blue-sensitive emulsion layer | |
| Emulsion J | 0.10 in terms of silver |
| Emulsion K | 0.20 in terms of silver |
| Gelatin | 1.00 |
| ExS-8 | $2.0 \times 10^{-4}$ |
| ExY-1 | $1.0 \times 10^{-2}$ |
| Coupler C-5 | 0.12 |
| ExY-3 | 0.90 |
| Cpd-2 | $1.0 \times 10^{-2}$ |
| HBS-1 | 0.30 |
| 12th layer: high sensitivity blue-sensitive emulsion layer | |
| Emulsion L | 0.40 in terms of silver |
| Gelatin | 0.40 |
| ExS-8 | $1.0 \times 10^{-4}$ |
| ExY-3 | 0.12 |
| Coupler C-5 | $1.0 \times 10^{-2}$ |
| Cpd-2 | $1.0 \times 10^{-3}$ |
| HBS-1 | $4.0 \times 10^{-2}$ |
| 13th layer: 1st protective layer | |
| Finely divided silver iodobromide grains (average grain diameter: 0.07 μm; AgI content: 1 mol %) | 0.20 |
| Gelatin | 0.70 |
| UV-2 | 0.10 |
| UV-3 | 0.10 |
| UV-4 | 0.20 |

-continued

| | |
|---|---|
| HBS-3 | $4.0 \times 10^{-2}$ |
| P-3 | $9.0 \times 10^{-2}$ |
| 14th layer: 2nd protective layer | |
| Gelatin | 0.50 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

In order to improve the preservability, processability, pressure resistance, mildew resistance, bacteria resistance, antistatic properties, and coating properties of the material, Cpd-3, Cpd-5,Cpd-6, Cpd-7, Cpd-8, P-1, P-2, W-1, W-2 and W-3 as shown later were incorporated in the various layers.

In addition to the aforementioned components, B-4, F-1 to F-11, iron salt, lead salt, gold salt, platinum salt, iridium salt, and rhodium salt were properly incorporated in the various layers.

TABLE 4

| Emulsion | Average AgI content (%) | Average grain in terms of sphere (μm) | Grain diameter distribution fluctuation coefficient (%) | Diameter/ thickness ratio | Average diameter in terms of circle by projected area (μm) | Average thickness (μm) |
|---|---|---|---|---|---|---|
| Emulsion | | | | | | |
| A | 2.0 | 0.2 | 12 | 1 | — | — |
| B | 2.0 | 0.3 | 14 | 1 | — | — |
| C | 4.7 | 0.3 | 12 | 1 | — | — |
| D | 4.7 | 0.5 | 8 | 1 | — | — |
| E | 8.8 | 0.65 | 22 | 6.5 | 1.06 | 0.16 |
| F | 2.9 | 0.15 | 16 | 1 | — | — |
| G | 2.9 | 0.25 | 18 | 1 | — | — |
| H | 4.7 | 0.45 | 10 | 1 | — | — |
| I | 8.8 | 0.60 | 25 | 7.2 | 1.01 | 0.14 |
| J | 3.0 | 0.2 | 30 | 4.5 | 0.29 | 0.064 |
| K | 3.0 | 0.5 | 26 | 7.0 | 0.84 | 0.12 |
| L | 9.0 | 0.85 | 23 | 6.5 | 1.39 | 0.21 |

TABLE 5

| Emulsion | Grain structure (iodine structure = silver amount ratio (% AgI content)) |
|---|---|
| Emulsion | |
| A | Uniform structure; cubic grain |
| B | Uniform structure; cubic grain |
| C | Triple structure = 4/1/5 (1/38/1); cubic grain |
| D | Triple structure = 4/1/5 (1/38/1); cubic grain |
| E | Triple structure = 12/59/29 (0/11/8); tabular grain |
| F | Triple structure = 45/5/50 (1/38/1); octahedral grain |
| G | Triple structure = 45/5/50 (1/38/1); octahedral grain |
| H | Triple structure = 4/1/5 (1/38/1); octahedral grain |
| I | Triple structure = 12/59/29 (0/11/8); tabular grain |
| J | Uniform structure; tabular grain |
| K | Uniform structure; tabular grain |
| L | Triple structure = 8/59/33 (0/11/8); tabular grain |

In Tables 4 and 5, (1) The various emulsions were subjected to reduction sensitization with thiourea dioxide and thiosulfonic acid in accordance with an example in JP-A-2-191938;

(2) The various emulsions were subjected to gold sensitization, sulfur sensitization and selenium sensitization in the presence of the spectral sensitizing dye as set forth with reference to the various light-sensitive layers and sodium thiocyanate in accordance with an example in JP-A-3-237450;

(3) The preparation of tabular grains was conducted with the use of a low molecular gelatin in accordance with JP-A-1-158426; and (4) The tabular grains and normal crystal grains having a grain structure were observed under a high voltage electron microscope to exhibit a transition line as described in JP-A-3-237450.

Comparative coupler (coupler as described in British Patent 909,318) C-1

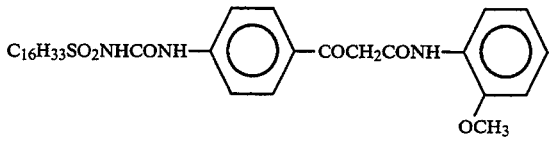

(coupler as described in JP-B-62-61251) C-2

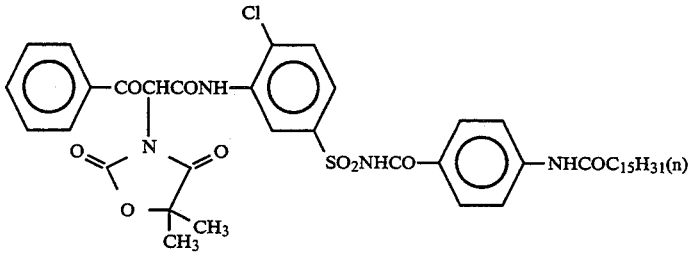

(coupler as described in JP-A-61-121054) C-3

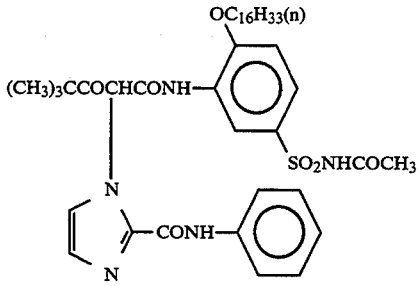

(coupler as described in JP-A-58-42045) C-4

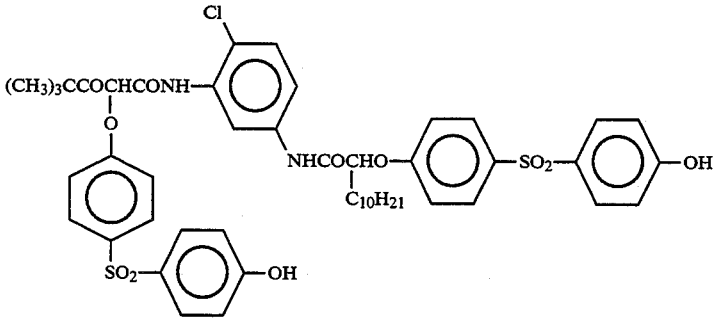

(Coupler as described in JP-A-2-28645) C-5

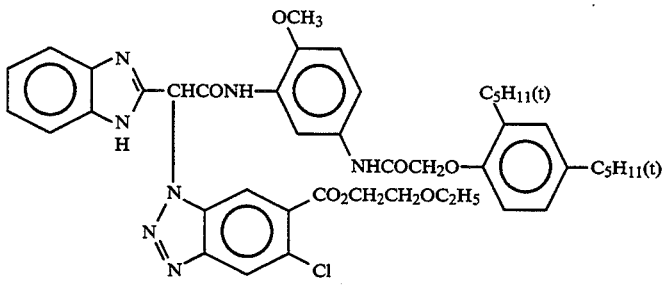

-continued
Comparative coupler
(Coupler as described in JP-A-2-2552) C-6
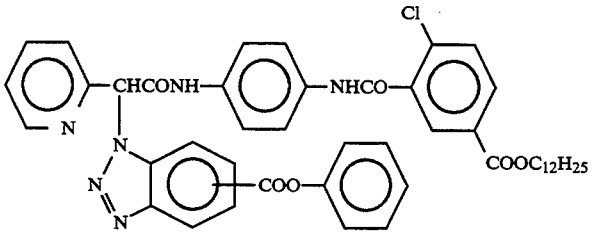
(Coupler as described in JP-A-63-261262) C-7
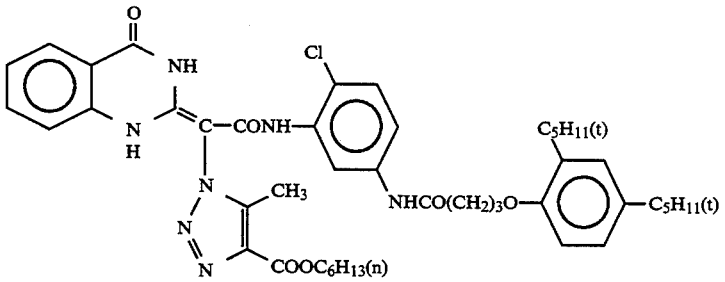
(Coupler similar to that coupler described in JP-A-52-69624) C-8
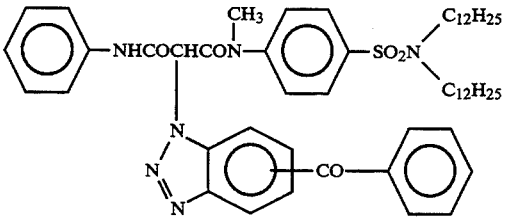
UV-1
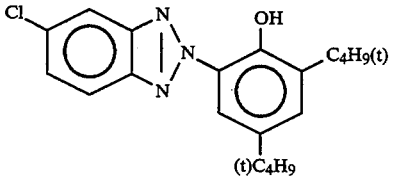
UV-2
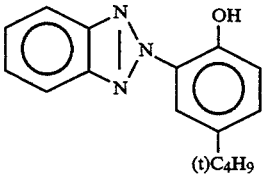
UV-3
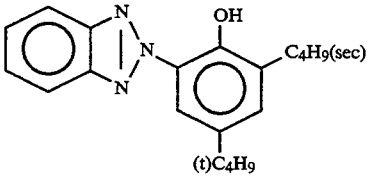
UV-4
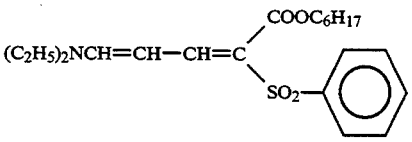
Tricresyl phosphate HBS-1
Dibutyl phthalate HBS-2
Tri(2-ethylhexyl)phosphate HBS-3
ExF-1
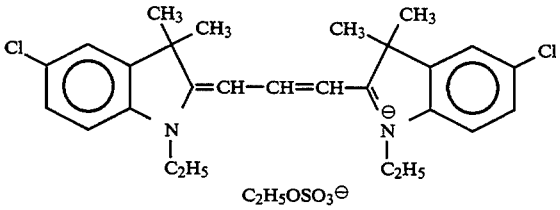

-continued
Comparative coupler
ExC-1
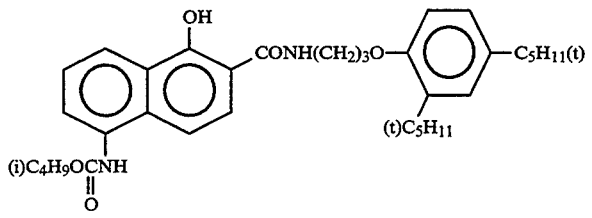
ExC-2
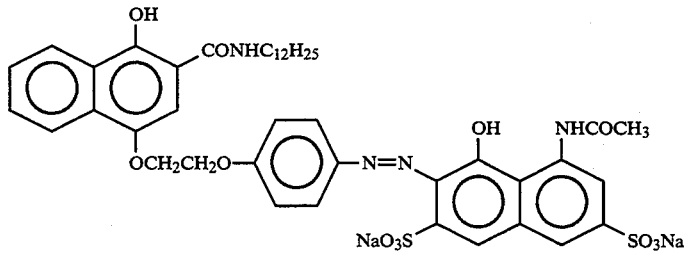
ExC-3
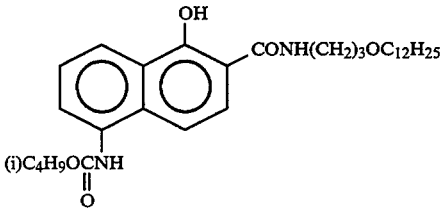
ExC-4
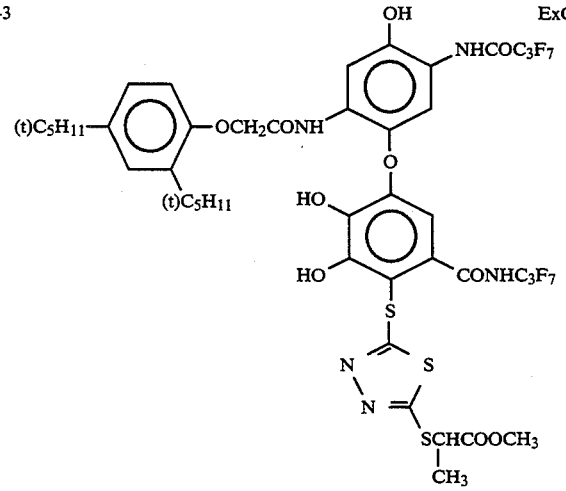
ExC-5
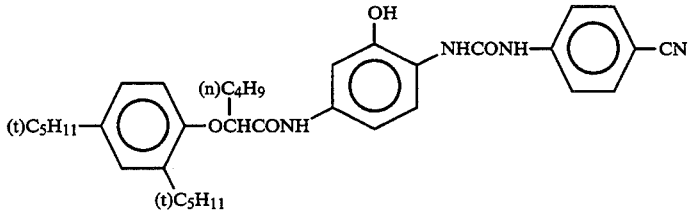
ExC-6
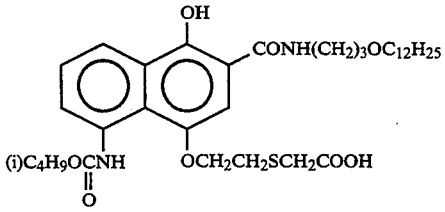

-continued
Comparative coupler
ExC-7
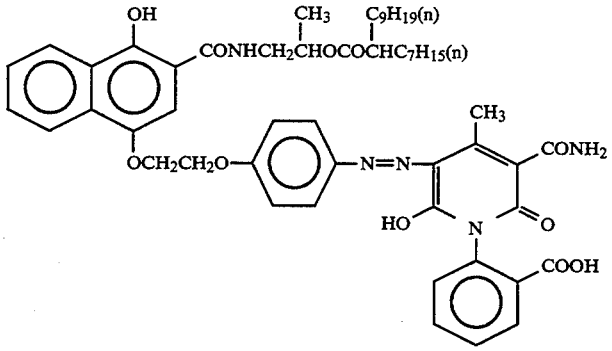
ExM-1
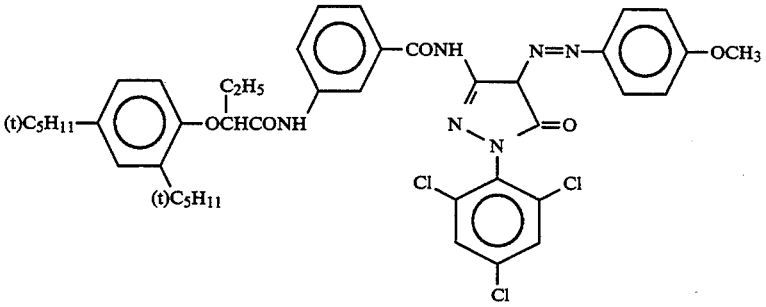
ExM-2
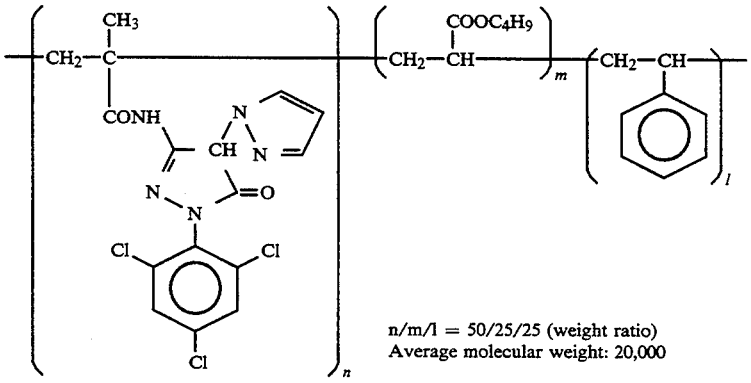
n/m/l = 50/25/25 (weight ratio)
Average molecular weight: 20,000
ExM-3
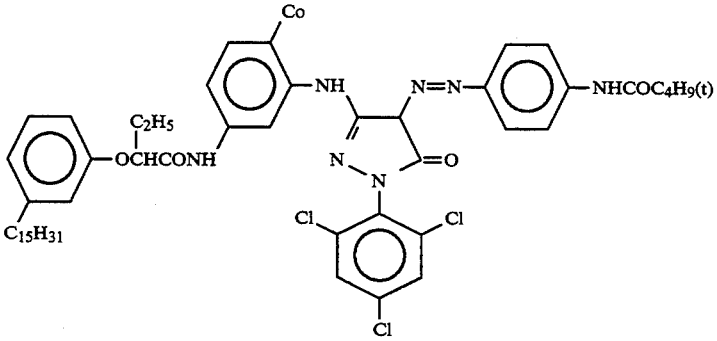

-continued
Comparative coupler
ExM-4
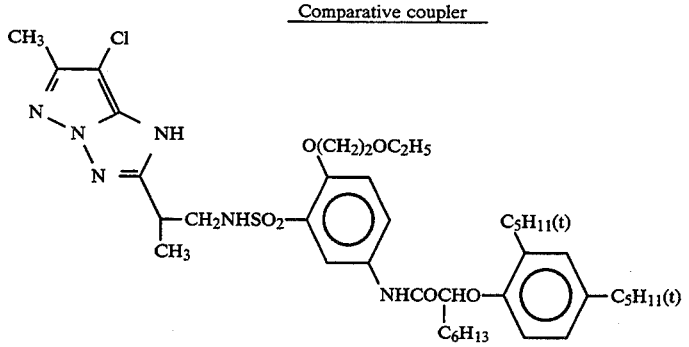
ExM-5
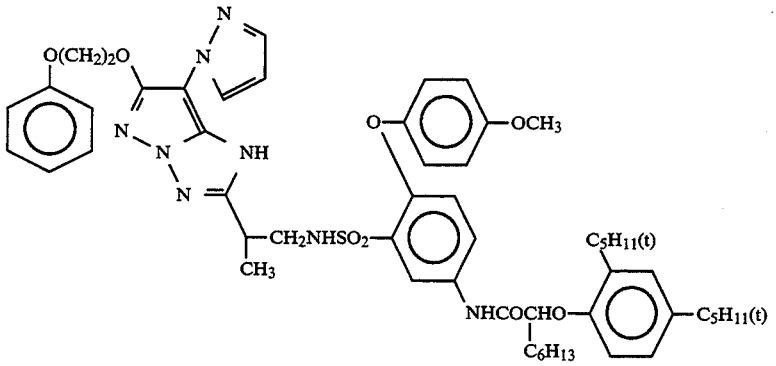
ExY-1
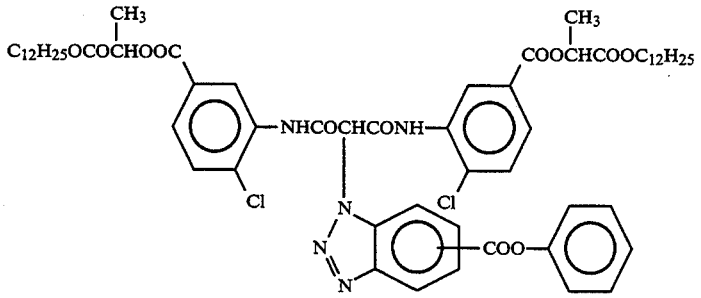
ExY-2
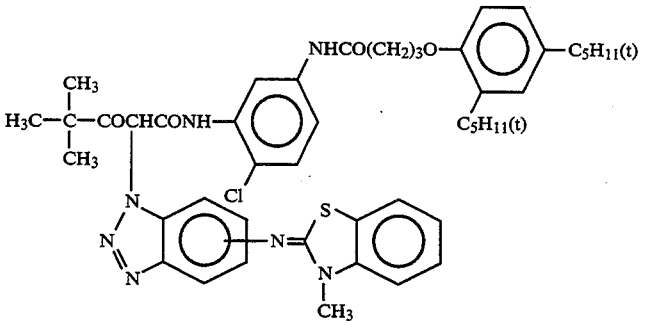
ExY-3
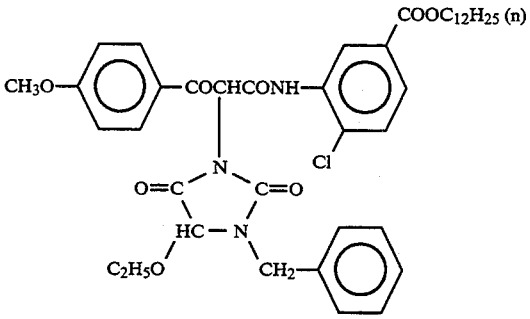
Cpd-1
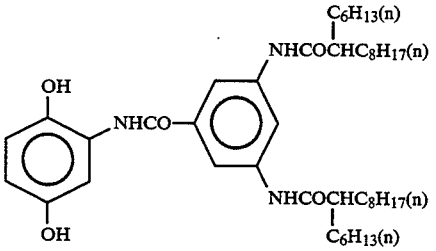

-continued
Comparative coupler
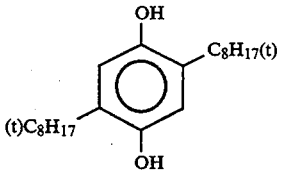
Cpd-2
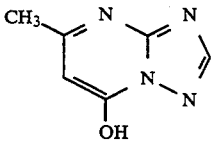
Cpd-3
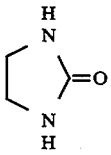
Cpd-4
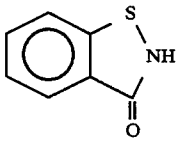
Cpd-5
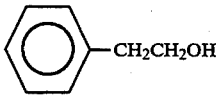
Cpd-6
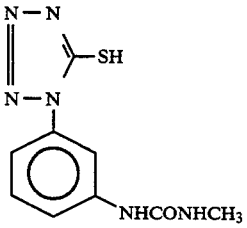
Cpd-7
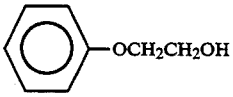
Cpd-8
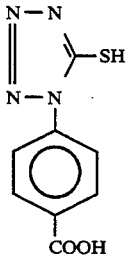
Cpd-9
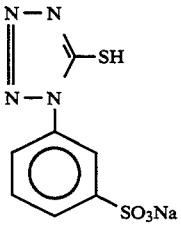
Cpd-10
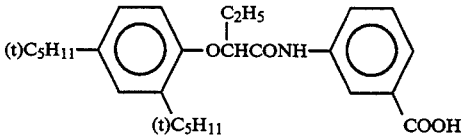
Cpd-11
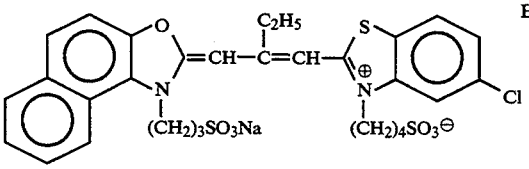
ExS-1
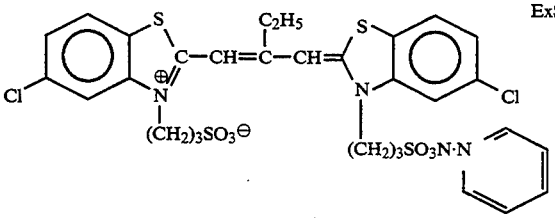
ExS-2
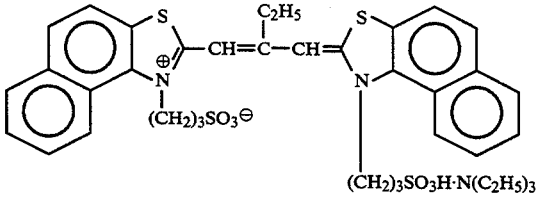
ExS-3

-continued
Comparative coupler
ExS-4
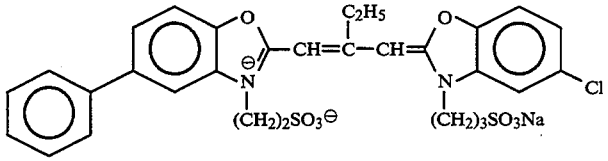
ExS-5
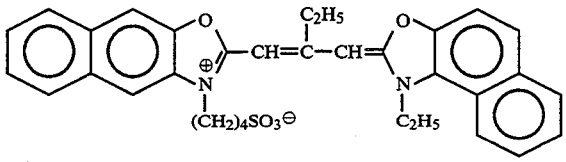
ExS-6
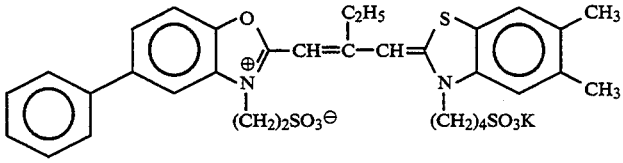
ExS-7
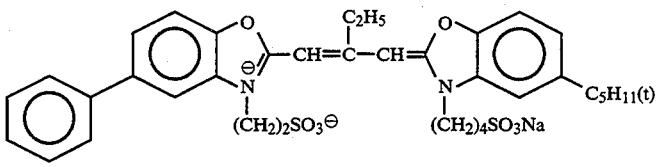
ExS-8
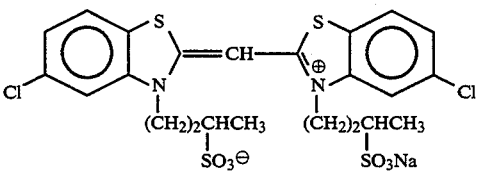
B-1
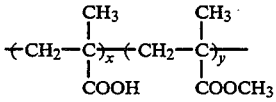
x/y = 10/90
B-2
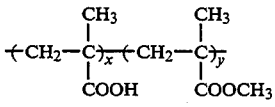
x/y = 40/60
B-3
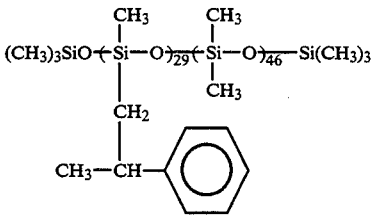
B-4
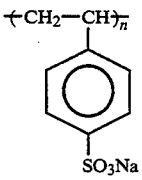
H-1
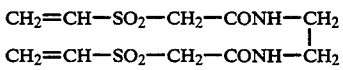
W-1
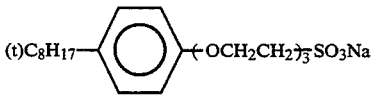
W-2
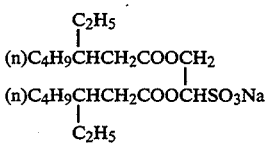
$C_8F_{17}SO_2N(C_3H_7)CH_2COOK$ W-3
Polymer of vinyl pyrrolidone and vinyl alcohol (copolymerization ratio = 70:30 [weight ratio]) P-1
Polyvinyl pyrrolidone (average molecular weight: about 10,000) P-2
Polyethyl acrylate P-3

-continued

Comparative coupler

F-1

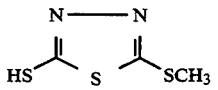

F-2

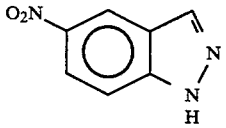

F-3

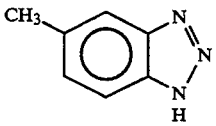

F-4

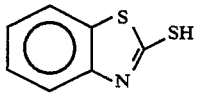

F-5

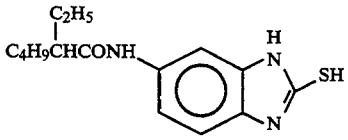

F-6

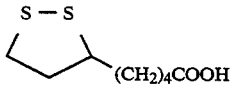

F-7

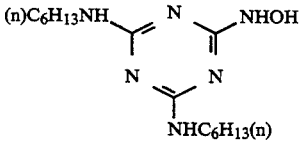

F-8

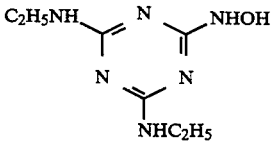

F-9

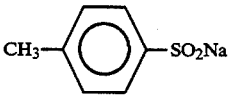

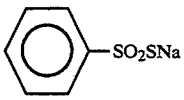

F-10

F-11

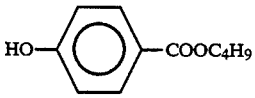

Specimens 402–408

Specimens 402 to 408 were prepared in the same manner as was Specimen 401, except that instead of incorporating the Coupler C-5 in the 4th, 7th, 8th, 9th, 11th and 12th layers, the comparative couplers and the couplers of the present invention were utilized as set forth in Table 6 in the molecular ratios as set forth in Table 6. The amounts of the couplers to be added to the specimens were determined such that the sensitivity and $\gamma$ of the specimens which had been imagewise exposed to white light, and then subjected to color development in the manner described hereinafter were almost the same.

These specimens were imagewise exposed to green light, and then subjected to color development in the manner described hereinafter. The degree of color stain was determined by subtracting the yellow fog density from the yellow density at a magenta density of (fog+1.0). The results are set forth in Table 6.

MTF value of the cyan image at 25 cycles/mm was determined. The measurement of MTF value was conducted in accordance with the method described in Mease, *The Theory of Photographic Process* 3*rd. ed.*, Macmillan.

The color photographic light-sensitive material specimens thus exposed were then subjected to processing by means of an automatic developing machine until the accumulated replenishment rate of the developer reached three times the tank capacity.

| | (Processing method) | | | |
|---|---|---|---|---|
| Step | Processing time | Processing temperature | Replenishment rate* | Tank Capacity |
| Color development | 3 min. 15 sec. | 38° C. | 22 ml | 20 l |

-continued

| | (Processing method) | | | |
|---|---|---|---|---|
| Step | Processing time | Processing temperature | Replenishment rate* | Tank Capacity |
| Bleach | 3 min. 00 sec. | 38° C. | 25 ml | 40 l |
| Rinse | 30 sec. | 24° C. | 1,200 ml | 20 l |
| Fixing | 3 min. 00 sec. | 38° C. | 25 ml | 30 l |
| Rinse (1) | 30 sec. | 24° C. | ** | 10 l |
| Rinse (2) | 30 sec. | 24° C. | 1,200 ml | 10 l |
| Stabilization | 30 sec. | 38° C. | 25 ml | 10 l |
| Drying | 4 min. 20 sec. | 55° C. | | |

*Replenishment rate: per 1-m long 35-mm wide specimen

**Countercurrent process in which the washing water flows backward

The various processing solution had the following compositions:

| | Running solution (g) | Replenisher (g) |
|---|---|---|
| Color developer | | |
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.3 |
| Potassium iodide | 1.5 mg | — |
| Hydroxylamine sulfate | 2.4 | 2.8 |
| 4-[N-ethyl-N-$\beta$-hydroxyethylamino]-2-methylaniline sulfate | 4.5 | 6.2 |
| Water to make | 1.0 l | 1.0 l |
| pH | 10.05 | 10.15 |
| Bleaching solution | | |
| Ferric sodium ethylenediaminetetraacetate trihydrate | 100.0 | 120.0 |

-continued

| | | |
|---|---|---|
| Disodium ethylenediamine-tetraacetate | 10.0 | 11.0 |
| 3-Mercapto-1,2,4-triazole | 0.08 | 0.09 |
| Ammonium bromide | 140.0 | 160.0 |
| Ammonium nitrate | 30.0 | 35.0 |
| 27% Aqueous ammonia | 6.5 ml | 4.0 ml |
| Water to make | 1.0 l | 1.0 l |
| pH | 6.0 | 5.7 |
| Fixing solution | | |
| Disodium ethylenediamine-tetraacetate | 0.5 | 0.7 |
| Ammonium sulfite | 20.0 | 22.0 |
| Aqueous solution of ammonium thiosulfate (700 g/l) | 290.0 ml | 320.0 ml |
| Water to make | 1.0 l | 1.0 l |
| pH | 6.7 | 7.0 |

| | Common to both running solution and replenisher (g) |
|---|---|
| Stabilizing solution | |
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl) piperazine | 0.75 |
| Water to make | 1.0 l |
| pH | 8.5 |

TABLE 6

| Specimen | Coupler in 4th, 7th, 8th, 9th, 11th, 12th layer Kind | Amount | Color stain degree | MTF value |
|---|---|---|---|---|
| 401 (comparative) | C-5 | 1.0 | 0.25 | 0.63 |
| 402 (comparative) | C-6 | 0.55 | 0.14 | 0.67 |
| 403 (comparative) | C-7 | 0.45 | 0.18 | 0.65 |
| 404 (comparative) | C-8 | 0.55 | 0.15 | 0.67 |
| 405 (present invention) | (29) | 0.25 | 0.07 | 0.74 |
| 406 (present invention) | (30) | 0.35 | 0.04 | 0.73 |
| 407 (present invention) | (31) | 0.30 | 0.06 | 0.74 |
| 408 (present invention) | (32) | 0.25 | 0.05 | 0.72 |

Table 6 shows that the couplers of the present invention, which have a high coupling activity, can exhibit a sufficient effect of inhibiting development and provide an excellent color reproducibility represented by color stain degree and an excellent sharpness represented by MTF value even when incorporated in a small amount.

As mentioned above, the use of the couplers of the present invention which exhibit a high dye forming rate and which provide a high color density can produce a color image having an excellent sharpness with an excellent color reproducibility.

While the invention has been described in detail with reference to certain specific embodiments thereof, it will be apparent to one skilled in the art that various changes and modifications can be made therein without departing from the spirit and scope thereof.

What is claimed is:

1. A silver halide color photographic material comprising a support having provided thereon at last one hydrophilic colloidal layer, wherein said hydrophilic colloidal layer contains a coupler compound represented by formula (I):

$$(R^1COCHXCONR^2R^3)—(CONHSO_2R^4)_n \quad (I)$$

wherein $R^1$ represents an alkyl group, a cycloalkyl group, an aryl group, a heterocyclic group, $—NR^5R^6$ or $—OR^7$; $R^2$ represents a hydrogen atom, an alkyl group, a cycloalkyl group, an aryl group or a heterocyclic group; $R^3$ represents a phenyl group; $R^4$ represents an alkyl group, a cycloalkyl group, an aryl group, a heterocyclic group or $—NR^8R^9$; $R^5$, $R^6$, $R^8$ and $R^9$ each independently represent a hydrogen atom, an alkyl group, a cycloalkyl group, an aryl group or a heterocyclic group; $R^7$ represents an alkyl group, a cycloalkyl group, an aryl group or a heterocyclic group; X represents a nitrogen containing heterocyclic group capable of being released as an anion ($X^-$) when said coupler compound reacts with an oxidation product of an aromatic primary amine developing agent; n represents an integer of 1 or more; with the proviso that the $—CONHSO_2R^4$ group(s) substitute directly for hydrogen atom(s) in $R^3$ phenyl group, and with the further proviso that $R^1$ and $R^4$, $R^2$ and $R^4$, $R^3$ and $R^4$, $R^2$ and $R^3$, $R^5$ and $R^6$, or $R^8$ and $R^9$ may be connected to each other to form a ring.

2. The silver halide color photographic material of claim 1, wherein $R^1$ represents an optionally substituted $C_{1-30}$ alkyl group, an optionally substituted $C_{2-30}$ cycloalkyl group, an optionally substituted $C_{6-20}$ aryl group, an optionally substituted 5–7 ring membered carbon containing heterocyclic group, $—NR^5R^6$ or $—OR^7$; $R^2$ and $R^3$ each independently represent a hydrogen atom, an optionally substituted $C_{1-30}$ alkyl group, an optionally substituted $C_{3-30}$ cycloalkyl group, an optionally substituted $C_{6-20}$ aryl group, an optionally substituted 5-7 ring membered carbon containing heterocyclic group or $—NR^8R^9$; $R^5$, $R^6$, $R^8$ and $R^9$ each independently represents a hydrogen atom, an optionally substituted $C_{1-30}$ alkyl group, an optionally substituted $C_{3-30}$ cycloalkyl group, an optionally substituted $C_{6-20}$ aryl group or an optionally substituted 5–7 ring membered carbon containing heterocyclic group; $R^7$ represents an optionally substituted $C_{1-30}$ alkyl group, an optionally substituted $C_{1-30}$ cycloalkyl group, an aryl group or a heterocyclic group.

3. The silver halide color photographic material of claim 2, wherein:

$R^1$ is an optionally substituted $C_{3-30}$ alkyl group, an optionally substituted $C_{3-30}$ cycloalkyl group, an optionally substituted $C_{6-10}$ aryl group, or $—NR^5R^6$, wherein $R^s$ or $R^6$ is an optionally substituted phenyl group;

$R^2$ is a hydrogen atom;

$R^3$ is an optionally substituted $C_{6-10}$ aryl group;

$R^4$ is an optionally substituted $C_{3-30}$ alkyl group, or an optionally substituted $C_{6-10}$ aryl group;

X is an nitrogen-containing heterocyclic group; and n is one.

4. The silver halide color photographic material of claim 2, wherein:

$R^1$, $R^2$, $R^3$, $R^4$, $R^5$, $R^6$, $R^7$ $R^8$ and $R^9$ are the same or different and are selected from the group consisting of:

an optionally substituted straight-chain or branch-chain $C_{1-30}$ alkyl group; an optionally substituted $C_{3-30}$ cycloalkyl group; an optionally substituted $C_{6-20}$ aryl group; an optionally substituted 5–7 ring membered carbon containing heterocyclic group having a nitrogen atom, an oxygen atom, or a sulfur atom as a ring hetero atom therein.

5. The silver halide color photographic material of claim 2, wherein $R^1$, $R^2$, $R^3$, $R^4$, $R^5$, $R^6$, $R^7$, $R^8$ or $R^9$ are the $C_{1-30}$ alkyl group, the $C_{3-30}$ cycloalkyl group, the $C_{6-20}$ aryl group or the 5–7 ring membered heterocyclic group substituted by a substituent selected from the group consisting of:

a halogen atom, a $C_{2-30}$ alkoxycarbonyl group, a $C_{2-30}$ acylamino group, a $C_{1-30}$ sulfonamide group, a $C_{1-30}$ carbamoyl group, a $C_{0-30}$ sulfamoyl group, a $C_{1-30}$ alkoxy group, a $C_{6-30}$ aryloxy group, a $C_{7-21}$ aryloxycarbonyl group, a $C_{2-30}$ N-acylsulfamoyl group, a $C_{1-30}$ sulfonyl group, a $C_{2-30}$ alkoxycarbonylamino group, a cyano group, a nitro group, a carboxyl group, a hydroxyl group, a sulfo group, a $C_{1-30}$ alkylthio group, a $C_{1-30}$ ureido group, a $C_{6-20}$ aryl group, a $C_{1-30}$ straight-chain or branch-chain alkyl group, a $C_{3-30}$ cycloalkyl group, a $C_{1-30}$ acyl group, a $C_{6-20}$ arylthio group, a $C_{0-30}$ sulfamoylamino group, a $C_{1-30}$ N-sulfonylsulfamoyl group, and a 3 to 12 ring membered carbon containing heterocyclic group having a nitrogen, oxygen or sulfur atom as a hetero ring atom therein.

6. The silver halide color photographic material of claim 4, wherein $R^1$, $R^2$, $R^3$, $R^4$, $R^5$, $R^6$, $R^7$, $R^8$ or $R^9$ are the $C_{1-30}$ alkyl group, the $C_{3-30}$ cycloalkyl group, the $C_{6-20}$ aryl group or the 5–7 ring membered heterocyclic group substituted by a substituent selected from the group consisting of:

a halogen atom, a $C_{2-30}$ alkoxycarbonyl group, a $C_{2-30}$ acylamino group, a $C_{1-30}$ sulfonamide group, a $C_{1-30}$ carbamoyl group, a $C_{0-30}$ sulfamoyl group, a $C_{1-30}$ alkoxy group, a $C_{6-30}$ aryloxy group, a $C_{7-21}$ aryloxycarbonyl group, a $C_{2-30}$ N-acylsulfamoyl group, a $C_{1-30}$ sulfonyl group, a $C_{2-30}$ alkoxycarbonylamino group, a cyano group, a nitro group, a carboxyl group, a hydroxyl group, a sulfo group, a alkylthio group, a $C_{1-30}$ ureido group, a $C_{6-20}$ aryl group, a $C_{1-30}$ straight-chain or branch-chain alkyl group, a $C_{3-30}$ cycloalkyl group, a $C_{1-30}$ acyl group, a $C_{6-20}$ arylthio group, a $C_{0-30}$ sulfamoylamino group, a $C_{1-30}$ N-sulfonylsulfamoyl group, and a 3 to 12 ring membered carbon containing heterocyclic group having a nitrogen, oxygen or sulfur atom as a hetero ring atom therein.

7. The silver halide color photographic material of claim 4, wherein:

$R^1$ is an optionally substituted $C_{3-30}$ alkyl group, an optionally substituted $C_{3-30}$ cycloalkyl group, an optionally substituted $C_{6-10}$ aryl group, or $-NR^5R^6$, wherein $R^5$ or $R^6$ is an optionally substituted phenyl group;

$R^2$ is a hydrogen atom;

$R^3$ is an optionally substituted $C_{6-10}$ aryl group;

$R^4$ is an optionally substituted $C_{3-30}$ alkyl group, or an optionally substituted $C_{6-10}$ aryl group;

X is an nitrogen-containing heterocyclic group; and n is one.

8. The silver halide color photographic material of claim 7, wherein

X is a 5-membered cyclic imide group connected to the coupling position via a nitrogen atom, 1-pyrazolyl, 1-imidazolyl, 1,2,4-triazolyl connected to the coupling position at its 1- or 4-position, 1-benzotriazolyl or 1,2,3-triazolyl.

9. The silver halide color photographic material of claim 8, wherein $R^1$, $R^3$, $R^4$, $R^5$, or $R^6$ is substituted by a substituent selected from the group consisting of:

a halogen atom, a $C_{2-30}$ alkoxycarbonyl group, a $C_{2-30}$ acylamino group, a $C_{1-30}$ sulfonamide group, a $C_{1-30}$ carbamoyl group, a $C_{0-30}$ sulfamoyl group, a $C_{1-30}$ alkoxy group, a $C_{6-30}$ aryloxy group, a $C_{7-21}$ aryloxycarbonyl group, a $C_{2-30}$ N-acylsulfamoyl group, a $C_{1-30}$ sulfonyl group, a $C_{2-30}$ alkoxycarbonylamino group, a cyano group, a nitro group, a carboxyl group, a hydroxyl group, a sulfo group, a $C_{1-30}$ alkylthio group, a $C_{1-30}$ ureido group, a $C_{6-20}$ aryl group, a $C_{1-30}$ straight-chain or branch-chain alkyl group, a $C_{3-30}$ cycloalkyl group, a $C_{1-30}$ acyl group, a $C_{6-20}$ arylthio group, a $C_{0-30}$ sulfamoylamino group, a $C_{1-30}$ N-sulfonylsulfamoyl group, and a 3 to 12 ring membered carbon containing heterocyclic group having a nitrogen, oxygen or sulfur atom as a hetero ring atom therein.

10. The silver halide color photographic material of claim 1, wherein the coupler of formula (I) forms a dimer or a higher polymer.

11. The silver halide color photographic material of claim 1, wherein the coupler of formula (I) is a nondiffusive coupler.

* * * * *